US011523227B2

(12) United States Patent
Leroux

(10) Patent No.: US 11,523,227 B2
(45) Date of Patent: Dec. 6, 2022

(54) SYSTEM AND METHOD FOR ADAPTIVE CALIBRATION OF SUBCUTANEOUS MICROPHONE

(71) Applicant: Cochlear Limited, Macquarie University (AU)

(72) Inventor: Thomas Leroux, Mougins (FR)

(73) Assignee: Cochlear Limited, Macquarie University (AU)

( * ) Notice: Subject to any disclaimer, the term of this patent is extended or adjusted under 35 U.S.C. 154(b) by 0 days.

(21) Appl. No.: 16/981,656

(22) PCT Filed: Apr. 3, 2019

(86) PCT No.: PCT/IB2019/052707
§ 371 (c)(1),
(2) Date: Sep. 16, 2020

(87) PCT Pub. No.: WO2019/193503
PCT Pub. Date: Oct. 10, 2019

(65) Prior Publication Data

US 2021/0099810 A1 Apr. 1, 2021

Related U.S. Application Data

(60) Provisional application No. 62/652,795, filed on Apr. 4, 2018.

(51) Int. Cl.
*H04R 25/00* (2006.01)

(52) U.S. Cl.
CPC ..... *H04R 25/305* (2013.01); *H04R 2225/39* (2013.01); *H04R 2225/67* (2013.01)

(58) Field of Classification Search
None
See application file for complete search history.

(56) References Cited

U.S. PATENT DOCUMENTS 8,553,901 B2 10/2013 Hersbach
8,840,540 B2 9/2014 Miller, III
(Continued)

FOREIGN PATENT DOCUMENTS

CN 102215796 A 10/2011
CN 104041078 A 9/2014
(Continued)

OTHER PUBLICATIONS

Chinese 1st Office Action received in Chinese Application No. 201980023861.2, dated Apr. 29, 2021 in 4 pages.
(Continued)

*Primary Examiner* — Walter F Briney, III
(74) *Attorney, Agent, or Firm* — Knobbe, Martens, Olson & Bear, LLP

(57) ABSTRACT

An apparatus includes at least one housing configured to be implanted within a body of a recipient, at least one acoustic transducer positioned on or within the at least one housing, at least one motion sensor positioned on or within the at least one housing, gain circuitry configured to apply a gain to transducer output signals from the at least one acoustic transducer, at least one storage device, and at least one processor operatively coupled to the at least one acoustic transducer, the at least one motion sensor, the gain circuitry, and the at least one storage device. The at least one processor is configured to adjust the gain circuitry in response to a reference acoustic sensitivity function, a reference vibration response function, the transducer output signals, and sensor output signals from the at least one motion sensor.

27 Claims, 15 Drawing Sheets

(56) References Cited

U.S. PATENT DOCUMENTS

| | | | | |
|---|---|---|---|---|
| 9,071,910 | B2 | 6/2015 | Van Gerwen | |
| 2006/0155346 | A1* | 7/2006 | Miller | H04R 25/606 607/57 |
| 2013/0281765 | A1 | 10/2013 | Miller, III | |
| 2014/0010379 | A1* | 1/2014 | Wellman | H04R 29/00 381/58 |
| 2014/0221729 | A1 | 8/2014 | Basinger | |
| 2016/0165362 | A1 | 6/2016 | Florent et al. | |
| 2016/0345107 | A1* | 11/2016 | Van Dijk | H04R 25/505 |
| 2018/0077507 | A1 | 3/2018 | Bernal Castillo et al. | |

FOREIGN PATENT DOCUMENTS

| | | | |
|---|---|---|---|
| CN | 105934219 | A | 9/2016 |
| EP | 3188508 | A1 | 7/2017 |

OTHER PUBLICATIONS

Search Report received in Chinese Application No. 201980023861.2, dated Apr. 25, 2021 in 3 pages.

International Search Report and Written Opinion, Application No. PCT/IB2019/052707, dated Aug. 2, 2019, in nine (9) pages.

* cited by examiner

SYSTEM AND METHOD FOR ADAPTIVE CALIBRATION OF SUBCUTANEOUS MICROPHONE

BACKGROUND

Field

The present application relates generally to auditory prostheses utilizing at least one subcutaneous microphone, and more specifically systems and methods for adaptive calibration of the at least one subcutaneous microphone.

Description of the Related Art

Auditory prostheses of various types are widely used to improve the lives of users. Such devices include, for example, hearing aids, cochlear implants, middle ear implants, and electro-acoustic devices. Forms of these devices which are "mostly implantable," "fully implantable," or "totally implantable" have the advantage of allowing the user to have a superior aesthetic result, as the recipient is visually indistinguishable in day-to-day activities from individuals that have not received such devices. Such devices also have a further advantage in generally being inherently waterproof, allowing the recipient to shower, swim, and so forth without needing to take any special measures. Examples of such devices include, but are not limited to, totally implanted cochlear implants ("TICIs") and fully implantable middle ear implants utilizing totally implantable actuators ("TIAs").

While conventional auditory prostheses use externally disposed microphone assemblies, certain mostly, fully, or totally implantable auditory prostheses use subcutaneously implantable microphone assemblies. Such microphone assemblies are configured to be positioned (e.g., in a surgical procedure) beneath the skin and on, within, or proximate to the recipient's skull and at a location that facilitates the receipt of acoustic signals by the microphone assembly once implanted (e.g., at a location between the recipient's skin and skull, rearward and upward of the recipient's ear or in the mastoid region).

SUMMARY

In one aspect disclosed herein, a method is provided which comprises providing an acoustic prosthesis comprising an assembly implanted within the body of a recipient. The implanted assembly comprises an acoustic transducer and a motion sensor. The method further comprises providing an acoustic sensitivity function of the acoustic transducer to acoustic signals having a first range of frequencies. The method further comprises storing the acoustic sensitivity function in a storage device of the implanted assembly. The method further comprises generating a vibration response function of the acoustic transducer to vibrations having a second range of frequencies. The method further comprises storing the vibration response function in the storage device of the implanted assembly.

In another aspect disclosed herein, a method is provided which comprises providing an implanted acoustic prosthesis comprising an assembly implanted within the body of a recipient. The implanted assembly comprises an acoustic transducer and a motion sensor. The method further comprises generating transducer output signals from the acoustic transducer and sensor output signals from the motion sensor. The method further comprises reducing noise in the transducer output signals in response to the sensor output signals to generate noise-reduced transducer output signals. The method further comprises updating a vibration response function of the acoustic transducer in response to the noise-reduced transducer output signals and the sensor output signals to generate an updated vibration response function. The method further comprises accessing a reference vibration response function of the acoustic transducer, the reference vibration response function previously stored in a storage device of the implanted assembly. The method further comprises accessing an acoustic sensitivity function of the acoustic transducer previously stored in the storage device of the implanted assembly. The method further comprises updating the acoustic sensitivity function in response to the updated vibration response function and the reference vibration response function to generate an updated acoustic sensitivity function.

In still another aspect disclosed herein, an apparatus is provided which comprises at least one housing configured to be implanted within a body of a recipient. The apparatus further comprises at least one acoustic transducer positioned on or within the at least one housing. The at least one acoustic transducer is configured to respond to sound by generating transducer output signals indicative of the sound. The apparatus further comprises at least one motion sensor positioned on or within the at least one housing. The at least one motion sensor is configured to respond to vibrations by generating sensor output signals indicative of the vibrations. The apparatus further comprises gain circuitry configured to receive the transducer output signals from the at least one acoustic transducer and to apply a gain to the transducer output signals. The apparatus further comprises at least one storage device comprising a reference acoustic sensitivity function of the at least one acoustic transducer and a reference vibration response function of the at least one acoustic transducer. The apparatus further comprises at least one processor operatively coupled to the at least one acoustic transducer, the at least one motion sensor, the gain circuitry, and the at least one storage device. The at least one processor is configured to adjust the gain circuitry in response to the reference acoustic sensitivity function, the reference vibration response function, the transducer output signals, and the sensor output signals.

BRIEF DESCRIPTION OF THE DRAWINGS

Embodiments are described herein in conjunction with the accompanying drawings, in which.

DETAILED DESCRIPTION

Figure 1:
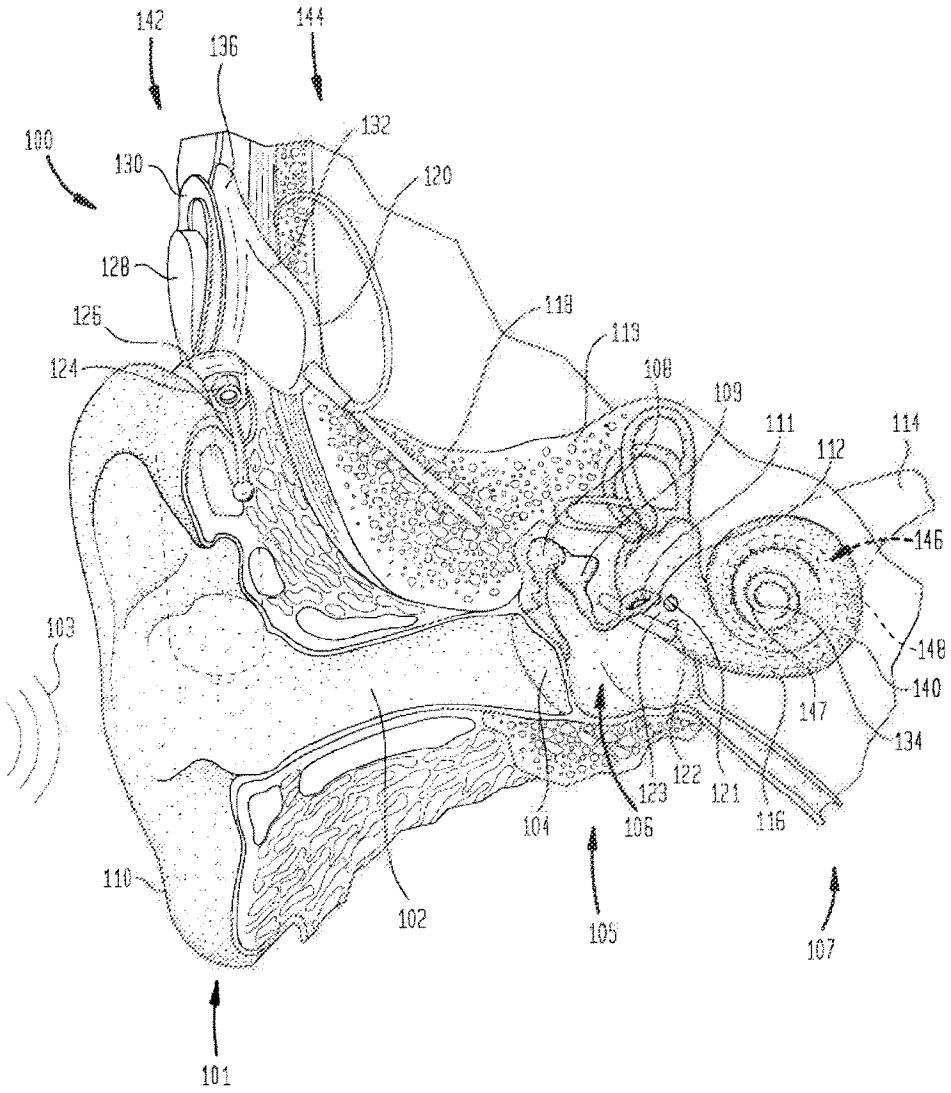
FIG. 1 is a perspective view of an example auditory prosthesis (e.g., cochlear implant), implanted in a recipient.

Certain embodiments described herein provide a system and method for adaptive calibration of subcutaneously implantable assemblies configured to be used in conjunction with "mostly implantable," "fully implantable," or "totally implantable" auditory prostheses. The acoustic response function of an acoustic transducer (e.g., microphone) of an implantable assembly can depend, at least in part, on various changing environmental factors, including but not limited to external pressure applied to the acoustic transducer of the assembly (e.g., atmospheric pressure applied to the acoustic transducer via the recipient's skin or other tissue covering the assembly) and thickness of the skin overlaying the implanted assembly. For example, changes of the external pressure applied to the acoustic transducer due to the recipient being in different situations (e.g., at different altitudes) can result in changes to the acoustic response function of the assembly. This dependence of the acoustic response function on the environmental conditions can contribute to variations of the acoustic response function which, if not corrected, can degrade the performance of the auditory prosthesis.

Certain embodiments described herein advantageously provide a system and method of modifying in situ the output signals from the assembly to account for changes of the acoustic response function, due to changes of the externally applied pressure, so that these output signals are more closely indicative of the acoustic signals received by the acoustic transducer. Certain embodiments described herein advantageously use the motion sensor output signals, which are indicative of the accelerations of the assembly and which are generally only used to remove the effects of vibrations on the transducer output signals, to detect changes of the vibration response function of the acoustic transducer due to changes of the environmental conditions from those that existed at the time of fitting of the acoustic prosthesis, and which are indicative of corresponding changes of the acoustic sensitivity function of the acoustic transducer due to the same changes of environmental conditions.

As used herein, the phrase "acoustic response function" of a device has its broadest reasonable interpretation, including referring to the output signals of the device as a function of the input acoustic signals received by the device. For example, the acoustic response function of an acoustic transducer can refer to the electrical output signals emitted by the acoustic transducer (e.g., the amplitude of these electrical output signals) as a function of the frequency of the input acoustic signals. As used herein, the phrase "vibration response function" of a device has its broadest reasonable interpretation, including referring to the output signals of the device as a function of the input vibrational signals received by the device. For example, the vibration response function of an acoustic transducer can refer to the electrical output signals emitted by the acoustic transducer (e.g., the amplitude of these electrical output signals) as a function of the frequency of the input vibrational signals.

The teachings detailed herein are applicable, in at least some embodiments, to any type of auditory prosthesis utilizing an implantable microphone assembly including but not limited to: hybrid electrical/acoustic systems, cochlear implant devices, implantable hearing aid devices, middle ear implant devices, bone conduction devices (e.g., active transcutaneous bone conduction devices), Direct Acoustic Cochlear Implant (DACI), and/or combinations or variations thereof, or any other suitable hearing prosthesis system with or without one or more external components. Embodiments can include any type of auditory prosthesis that can utilize the teachings detailed herein and/or variations thereof. In some embodiments, the teachings detailed herein and/or variations thereof can be utilized in other types of prostheses beyond auditory prostheses.

FIG. 1 is a perspective view of an example auditory prosthesis 100 (e.g., cochlear implant), implanted in a recipient. The example auditory prosthesis 100 is shown in FIG. 1 as comprising an external microphone assembly 124. An example auditory prosthesis 100 (e.g., a totally implantable cochlear implant) in accordance with certain embodiments described herein can replace the external microphone assembly 124 shown in FIG. 1 with a subcutaneously implantable assembly comprising an acoustic transducer (e.g., microphone), as described more fully herein.

As shown in FIG. 1, the recipient has an outer ear 101, a middle ear 105, and an inner ear 107. In a fully functional ear, the outer ear 101 comprises an auricle 110 and an ear canal 102. An acoustic pressure or sound wave 103 is collected by the auricle 110 and is channeled into and through the ear canal 102. Disposed across the distal end of the ear canal 102 is a tympanic membrane 104 which vibrates in response to the sound wave 103. This vibration is coupled to oval window or fenestra ovalis 112 through three bones of middle ear 105, collectively referred to as the ossicles 106 and comprising the malleus 108, the incus 109, and the stapes 111. The bones 108, 109, and 111 of the middle ear 105 serve to filter and amplify the sound wave 103, causing the oval window 112 to articulate, or vibrate in response to vibration of the tympanic membrane 104. This vibration sets up waves of fluid motion of the perilymph within cochlea 140. Such fluid motion, in turn, activates tiny hair cells (not shown) inside the cochlea 140. Activation of the hair cells causes appropriate nerve impulses to be generated and transferred through the spiral ganglion cells (not shown) and auditory nerve 114 to the brain (also not shown) where they are perceived as sound.

As shown in FIG. 1, the example auditory prosthesis 100 comprises one or more components which are temporarily or permanently implanted in the recipient. The example auditory prosthesis 100 is shown in FIG. 1 with an external component 142 which is directly or indirectly attached to the recipient's body, and an internal component 144 which is temporarily or permanently implanted in the recipient (e.g., positioned in a recess of the temporal bone adjacent auricle 110 of the recipient). The external component 142 typically comprises one or more sound input elements (e.g., an external microphone 124) for detecting sound, a sound processing unit 126 (e.g., disposed in a Behind-The-Ear unit), a power source (not shown), and an external transmitter unit 128. In the illustrative embodiments of FIG. 1, the external transmitter unit 128 comprises an external coil 130 (e.g., a wire antenna coil comprising multiple turns of electrically insulated single-strand or multi-strand platinum or gold wire) and, preferably, a magnet (not shown) secured directly or indirectly to the external coil 130. The external coil 130 of the external transmitter unit 128 is part of an inductive radio frequency (RF) communication link with the internal component 144. The sound processing unit 126 processes the output of the microphone 124 that is positioned externally to the recipient's body, in the depicted embodiment, by the recipient's auricle 110. The sound processing unit 126 generates encoded signals, sometimes referred to herein as encoded data signals, which are provided to the external transmitter unit 128 (e.g., via a cable).

The power source of the external component 142 is configured to provide power to the auditory prosthesis 100, where the auditory prosthesis 100 includes a battery (e.g., located in the internal component 144, or disposed in a separate implanted location) that is recharged by the power provided from the external component 142 (e.g., via a transcutaneous energy transfer link). The transcutaneous energy transfer link is used to transfer power and/or data to the internal component 144 of the auditory prosthesis 100. Various types of energy transfer, such as infrared (IR), electromagnetic, capacitive, and inductive transfer, may be used to transfer the power and/or data from the external component 142 to the internal component 144. During operation of the auditory prosthesis 100, the power stored by the rechargeable battery is distributed to the various other implanted components as needed.

The internal component 144 comprises an internal receiver unit 132, a stimulator unit 120, and an elongate electrode assembly 118. In some embodiments, the internal receiver unit 132 and the stimulator unit 120 are hermetically sealed within a biocompatible housing. The internal receiver unit 132 comprises an internal coil 136 (e.g., a wire antenna coil comprising multiple turns of electrically insulated single-strand or multi-strand platinum or gold wire), and preferably, a magnet (also not shown) fixed relative to the internal coil 136. The internal receiver unit 132 and the stimulator unit 120 are hermetically sealed within a biocompatible housing, sometimes collectively referred to as a stimulator/receiver unit. The internal coil 136 receives power and/or data signals from the external coil 130 via a transcutaneous energy transfer link (e.g., an inductive RF link). The stimulator unit 120 generates electrical stimulation signals based on the data signals, and the stimulation signals are delivered to the recipient via the elongate electrode assembly 118.

The elongate electrode assembly 118 has a proximal end connected to the stimulator unit 120, and a distal end implanted in the cochlea 140. The electrode assembly 118 extends from the stimulator unit 120 to the cochlea 140 through the mastoid bone 119. In some embodiments, the electrode assembly 118 may be implanted at least in the basal region 116, and sometimes further. For example, the electrode assembly 118 may extend towards apical end of cochlea 140, referred to as cochlea apex 134. In certain circumstances, the electrode assembly 118 may be inserted into the cochlea 140 via a cochleostomy 122. In other circumstances, a cochleostomy may be formed through the round window 121, the oval window 112, the promontory 123, or through an apical turn 147 of the cochlea 140.

The elongate electrode assembly 118 comprises a longitudinally aligned and distally extending array 146 of electrodes or contacts 148, sometimes referred to as electrode or contact array 146 herein, disposed along a length thereof. Although the electrode array 146 can be disposed on the electrode assembly 118, in most practical applications, the electrode array 146 is integrated into the electrode assembly 118 (e.g., the electrode array 146 is disposed in the electrode assembly 118). As noted, the stimulator unit 120 generates stimulation signals which are applied by the electrodes 148 to the cochlea 140, thereby stimulating the auditory nerve 114.

While the external component 142 is shown in FIG. 1 as including an external microphone 124, in certain embodiments described herein, the auditory prosthesis 100 comprises a subcutaneously implantable assembly comprising an acoustic transducer (e.g., microphone)(not shown in FIG. 1). For example, in some embodiments, the internal component 144 includes an implantable microphone assembly (not shown) and a sound processing unit (not shown) to convert the sound signals received by the implantable microphone assembly to data signals. In some alternative embodiments, the implantable microphone assembly can be located in a separate implantable component (e.g., that has its own housing assembly, etc.) that is in signal communication with the internal component 144 (e.g., via leads or the like between the separate implantable component and the implantable component 144). As will be appreciated, the sound processing unit may utilize digital processing techniques to provide frequency shaping, amplification, compression, and other signal conditioning, including conditioning based on recipient-specific fitting parameters. In at least some embodiments, the teachings detailed herein and/or variations thereof can be utilized with any type of implantable microphone arrangement.

In certain embodiments, the external microphone 124 can be used to supplement the microphone of the implantable assembly of the auditory prosthesis 100. In other embodiments, the auditory prosthesis 100 includes a stand-alone external microphone that is separate from the external component 142. Thus, the external component 142 shown in FIG. 1 is merely illustrative, and other external components or devices may be used with embodiments described herein.

Figure 2:
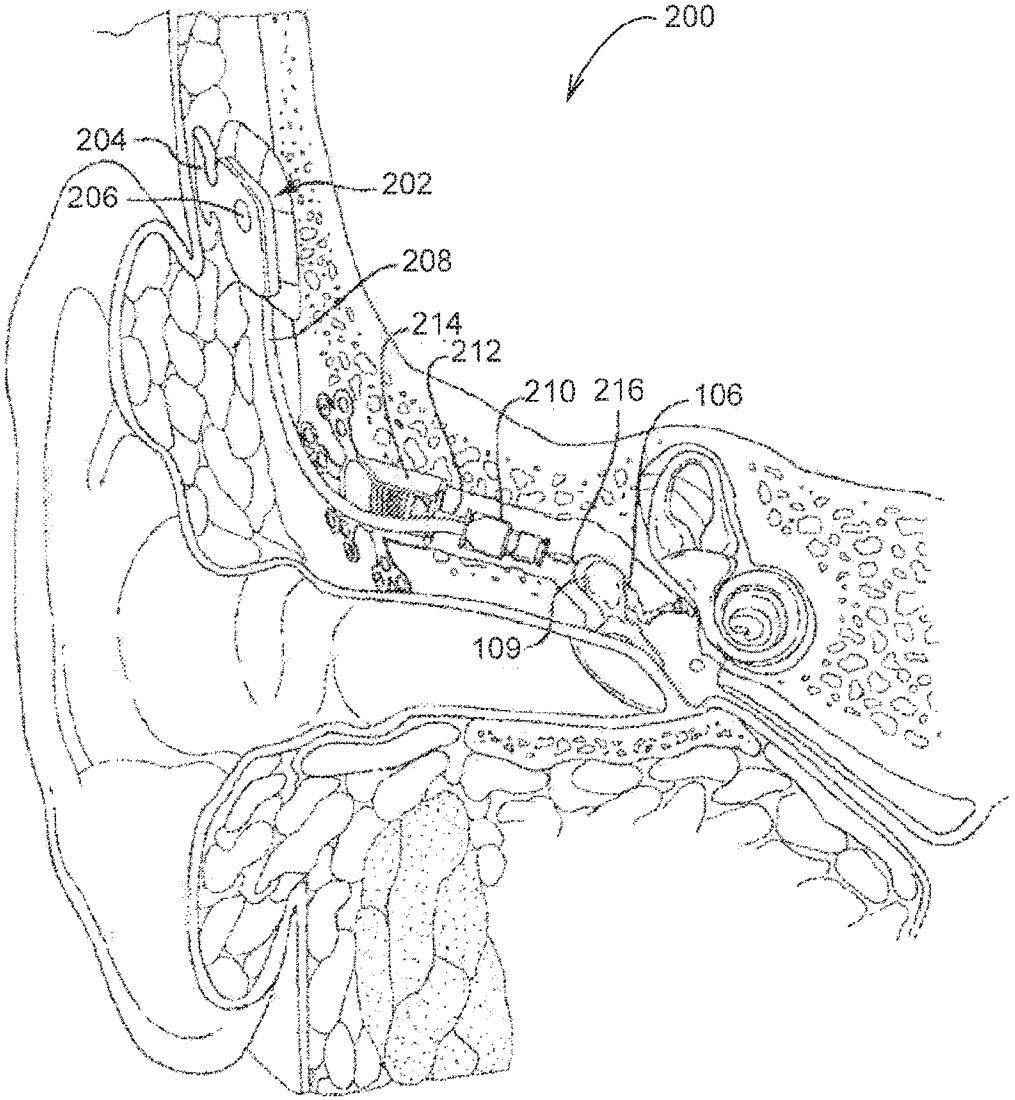
FIG. 2 is a perspective view of an example fully implantable auditory prosthesis (e.g., fully implantable middle ear implant), implanted in a recipient, utilizing a totally implantable actuator ("TIA") in accordance with certain embodiments described herein.

FIG. 2 schematically illustrates a perspective view of an example fully implantable auditory prosthesis 200 (e.g., fully implantable middle ear implant), implanted in a recipient, utilizing a totally implantable actuator ("TIA") in accordance with certain embodiments described herein. The example auditory prosthesis 200 of FIG. 2 comprises a biocompatible microphone assembly 202 (e.g., comprising an implantable capsule) located subcutaneously (e.g., beneath the recipient's skin and on a recipient's skull). The microphone assembly 202 includes a signal receiver 204

(e.g., comprising a coil element) and an acoustic transducer 206 (e.g., comprising an electret diaphragm or a piezoelectric diaphragm) that is positioned to receive acoustic signals through the recipient's overlying tissue. The microphone assembly 202 may further be utilized to house a number of components of the fully implantable auditory prosthesis 200. For example, the microphone assembly 202 can include an energy storage device and a signal processor (e.g., a sound processing unit). Various additional processing logic and/or circuitry components can also be included in the microphone assembly 202 as a matter of design choice.

For the example auditory prosthesis 200 shown in FIG. 2, the signal processor of the implantable microphone assembly 202 is in operative communication (e.g., electrically interconnected via a wire 208) with an actuator 210 (e.g., TIA comprising a transducer configured to generate mechanical vibrations in response to electrical signals from the microphone assembly 202). In certain embodiments, the auditory prosthesis 100 shown in FIG. 1 can comprise an implantable microphone assembly, such as the microphone assembly 202 shown in FIG. 2. For such an example auditory prosthesis 100, the signal processor of the implantable microphone assembly 202 can be in operative communication (e.g., electrically interconnected via a wire) with the stimulator unit of the main implantable component 120.

The actuator 210 of the example auditory prosthesis 200 shown in FIG. 2 is supportably connected to a positioning system 212, which in turn, is connected to a bone anchor 214 mounted within the recipient's mastoid process (e.g., via a hole drilled through the skull). The actuator 210 includes a connection apparatus 216 for connecting the actuator 210 to the ossicles 106 of the recipient. In a connected state, the connection apparatus 216 provides a communication path for acoustic stimulation of the ossicles 106 (e.g., through transmission of vibrations from the actuator 210 to the incus 109).

During normal operation, ambient acoustic signals (e.g., ambient sound) impinge on the recipient's tissue and are received transcutaneously at the acoustic transducer 206. Upon receipt of the transcutaneous signals, a signal processor within the microphone assembly 202 processes the signals to provide a processed audio drive signal via wire 208 to the actuator 210. As will be appreciated, the signal processor may utilize digital processing techniques to provide frequency shaping, amplification, compression, and other signal conditioning, including conditioning based on recipient-specific fitting parameters. The audio drive signal causes the actuator 210 to transmit vibrations at acoustic frequencies to the connection apparatus 216 to effect the desired sound sensation via mechanical stimulation of the incus 109 of the recipient.

The subcutaneously implantable microphone assembly 202 is configured to respond to auditory signals (e.g., sound; pressure variations in an audible frequency range) by generating output signals (e.g., electrical signals; optical signals; electromagnetic signals) indicative of the auditory signals received by the microphone assembly 202, and these output signals are used by the auditory prosthesis 100, 200 to generate stimulation signals which are provided to the recipient's auditory system. To compensate for the decreased acoustic signal strength reaching the microphone assembly 202 by virtue of being implanted, the diaphragm of an implantable microphone assembly 202 is configured to provide higher sensitivity than are external non-implantable microphone assemblies (e.g., by using diaphragms that are larger than diaphragms for external non-implantable microphone assemblies).

However, this heightened acoustic sensitivity also makes the implantable microphone assembly more sensitive to other signals or contributions which contribute noise or other undesirable effects to the stimulation signals. These non-ambient noise signals, in at least some embodiments, are not of an energy level and/or frequency to be audible at a location away from the recipient, but still result in vibrations detected by the acoustic transducer 206 (e.g., vibrations of the diaphragm of the acoustic transducer 206). For example, with regard to both auditory prostheses 100 (e.g., TICIs) and auditory prostheses 200 (e.g., utilizing TIAs), biological sources may cause vibrations (e.g., biological noise) which are conducted to the implanted microphone assembly 202 through the recipient's tissue. Such biological sources may include, without limitation, vibrations caused by speaking, chewing, movement of the recipient's tissue over the microphone assembly 202 (e.g., caused by the recipient turning their head), and the like. For another example, with regard to auditory prostheses 200 (e.g., utilizing TIAs), upon operation of the actuator 210, vibrations are applied to the incus 109, but such vibrations are also applied to the bone anchor 214. The vibrations applied to the bone anchor 214 are likewise conveyed to the recipient's skull from where they may be conducted to the microphone assembly 202 and/or to tissue overlying the acoustic transducer 206. Accordingly such vibrations may be applied to the acoustic transducer 206 and thereby included in the output response of the microphone assembly 202. Stated otherwise, mechanical feedback from operation of the actuator 210 may be received by the acoustic transducer 206 of the implanted microphone assembly 202 via a feedback loop formed through the recipient's tissue. Further, application of vibrations to the incus 109 may also vibrate the eardrum 104, thereby causing sound pressure waves, which may pass through the ear canal 102 where they may be received by the acoustic transducer 206 of the implanted microphone assembly 202 as ambient sound.

Figure 3A:
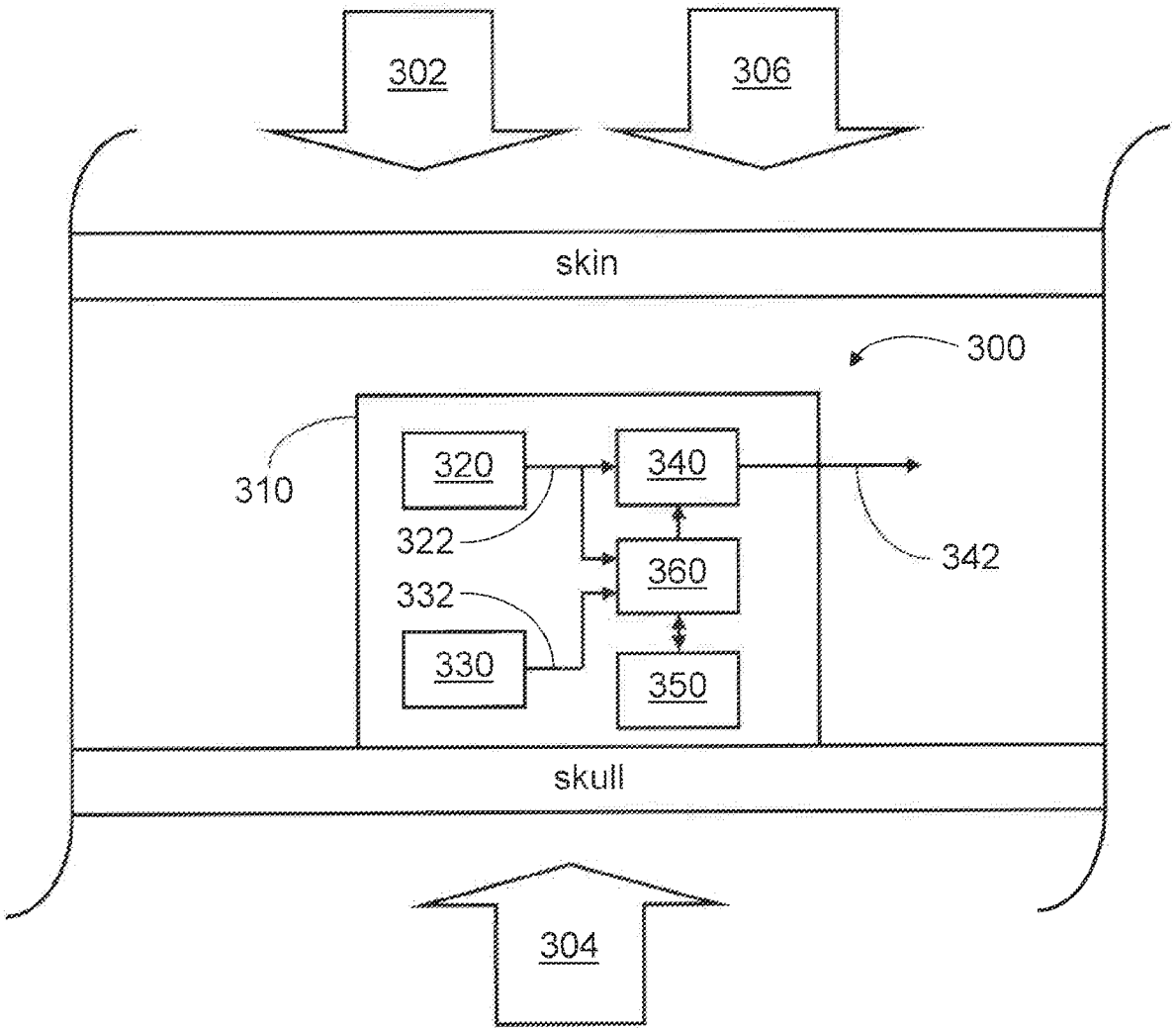
FIG. 3A schematically illustrates an example implantable assembly in accordance with certain embodiments described herein and FIG. 3B schematically illustrates another example implantable assembly in accordance with certain embodiments described herein.
Figure 3B:
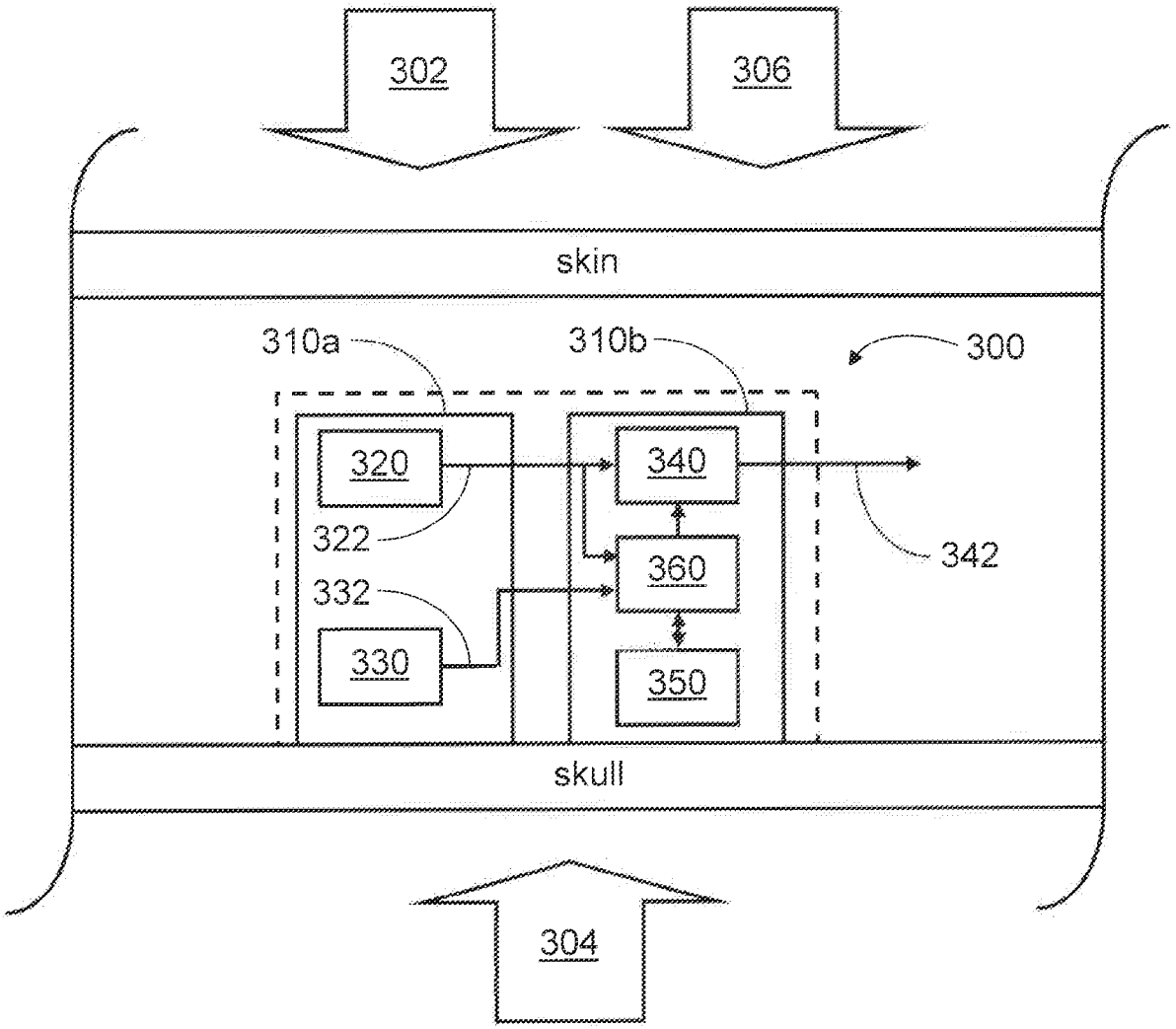

FIG. 3A schematically illustrates an example implantable assembly 300 in accordance with certain embodiments described herein and FIG. 3B schematically illustrates another example implantable assembly 300 in accordance with certain embodiments described herein. As shown in FIGS. 3A and 3B, the assembly 300 is exposed to ambient acoustic signals 302 received from a source that is external to the recipient, vibrations 304 received from a source that is internal to the recipient, and atmospheric pressure 306 applied to the at least one acoustic transducer 320 via the recipient's skin or other tissue covering the assembly 300. The assembly 300 can be a component of a cochlear implant system, a middle ear implant system, or another type of acoustic prosthesis system.

As schematically illustrated by FIGS. 3A and 3B, the assembly 300 comprises at least one housing 310, at least one acoustic transducer 320, and at least one motion sensor 330 (e.g., at least one accelerometer) in accordance with certain embodiments described herein. The at least one housing 310 comprises a biocompatible material and is configured to be implanted within a body of a recipient. For example, the at least one housing 310 is configured to be adhered to (e.g., affixed onto) a surface of the recipient's skull and to be positioned between the recipient's skull and tissue (e.g., skin). The at least one acoustic transducer 320 is positioned on or within the at least one housing 310, and is configured to respond to sound (e.g., ambient acoustic signals 302 received from a source that is external to the recipient) by generating transducer output signals 322 indicative of the sound. The at least one motion sensor 330 is positioned on or within the at least one housing 310, and is configured to respond to vibrations (e.g., vibrations 304 received from a source that is internal to the recipient) by generating sensor output signals 332 indicative of the vibrations.

In FIG. 3A, the at least one housing 310 comprises a single housing 310 containing the at least one acoustic transducer 320, the at least one motion sensor 330, at least one processor 360, gain circuitry 340, and at least one storage device 350. In FIG. 3B, the at least one housing 310 comprises at least one first housing 310*a* containing the at least one acoustic transducer 320 and the at least one motion sensor 330, and a second housing 310*b* containing the at least one processor 360, the gain circuitry 340, and the at least one storage device 350. While FIGS. 3A and 3B show the at least one motion sensor 330 positioned within the same housing 310, 310*a* of the assembly 300 as the at least one acoustic transducer 320, alternatively, the at least one motion sensor 330 can be mounted anywhere (e.g., in a housing 320*b* separate from the housing 320*a* containing the at least one acoustic transducer 320; in a housing separate from the assembly 300) such that it enables the provision of a sufficiently accurate representation of the vibrations received by the assembly 300 (e.g., by the diaphragm of the acoustic transducer 320). In an exemplary embodiment, the at least one motion sensor 330 is substantially isolated from the receipt of the ambient acoustic signals 304 that pass transcutaneously through the tissue and are received by the at least one acoustic transducer 320.

The assembly 300 further comprises gain circuitry 340 configured to receive the transducer output signals 322 from the at least one acoustic transducer 320 and to apply a gain to the transducer output signals 322. The assembly 300 further comprises at least one storage device 350 and at least one processor 360. The at least one storage device 350 (e.g., non-volatile memory; flash memory) comprises a reference acoustic sensitivity function of the at least one acoustic transducer 320 and a reference vibration response function of the at least one acoustic transducer 320. The at least one processor 360 (e.g., microelectronic circuitry) is operatively coupled to the at least one acoustic transducer 320, the at least one motion sensor 330, the gain circuitry 340, and the at least one storage device 350. The at least one processor 360 is configured to adjust the gain circuitry 340 in response to the reference acoustic sensitivity function, the reference vibration response function, the transducer output signals 322, and the sensor output signals 332.

As described more fully herein, the at least one processor 360 can be further configured to, in response to the transducer output signals 322 and the sensor output signals 332, generate a vibration response function of the at least one acoustic transducer 320. The at least one processor 360 can also be configured to perform a comparison of the vibration response function to the reference vibration response function and to update the reference acoustic sensitivity function in response to the comparison of the vibration response function and the reference vibration response function. In certain embodiments, the at least one processor 360, the gain circuitry 340, and the at least one storage device 350 are within the housing 310 (e.g., within a housing 310 that also contains the at least one acoustic transducer 320 and the at least one motion sensor 330 as in FIG. 3A; within a housing 310*b* separate from a housing 310*a* containing the at least one acoustic transducer 320 and the at least one motion sensor 330 as in FIG. 3B).

The at least one motion sensor 330 generates the sensor output signals 332 indicative of motion (e.g., caused by vibration and/or acceleration), whereas the at least one acoustic transducer 320 generates the transducer output signals 322 indicative of both transcutaneously received acoustic sound and motion. Accordingly, the assembly 300 utilizes the sensor output signals 332 from the at least one motion sensor 330 to reduce (e.g., remove) the effects of motion and noise, including mechanical feedback and biological noise, from the transducer output signals 322 from the at least one acoustic transducer 320, thereby providing an output response of the implantable assembly 300 less affected by the non-ambient noise signals. In addition, as described more fully herein, the implantable assembly 300 is configured to use the sensor output signals 332 from the at least one motion sensor 330 to reduce (e.g., remove) the effects of one or more changing environmental factors (e.g., atmospheric pressure 306 applied to the at least one acoustic transducer 320 via the recipient's skin and other tissue covering the assembly 300; thickness of the skin overlaying the implanted assembly 300).

Figure 4:
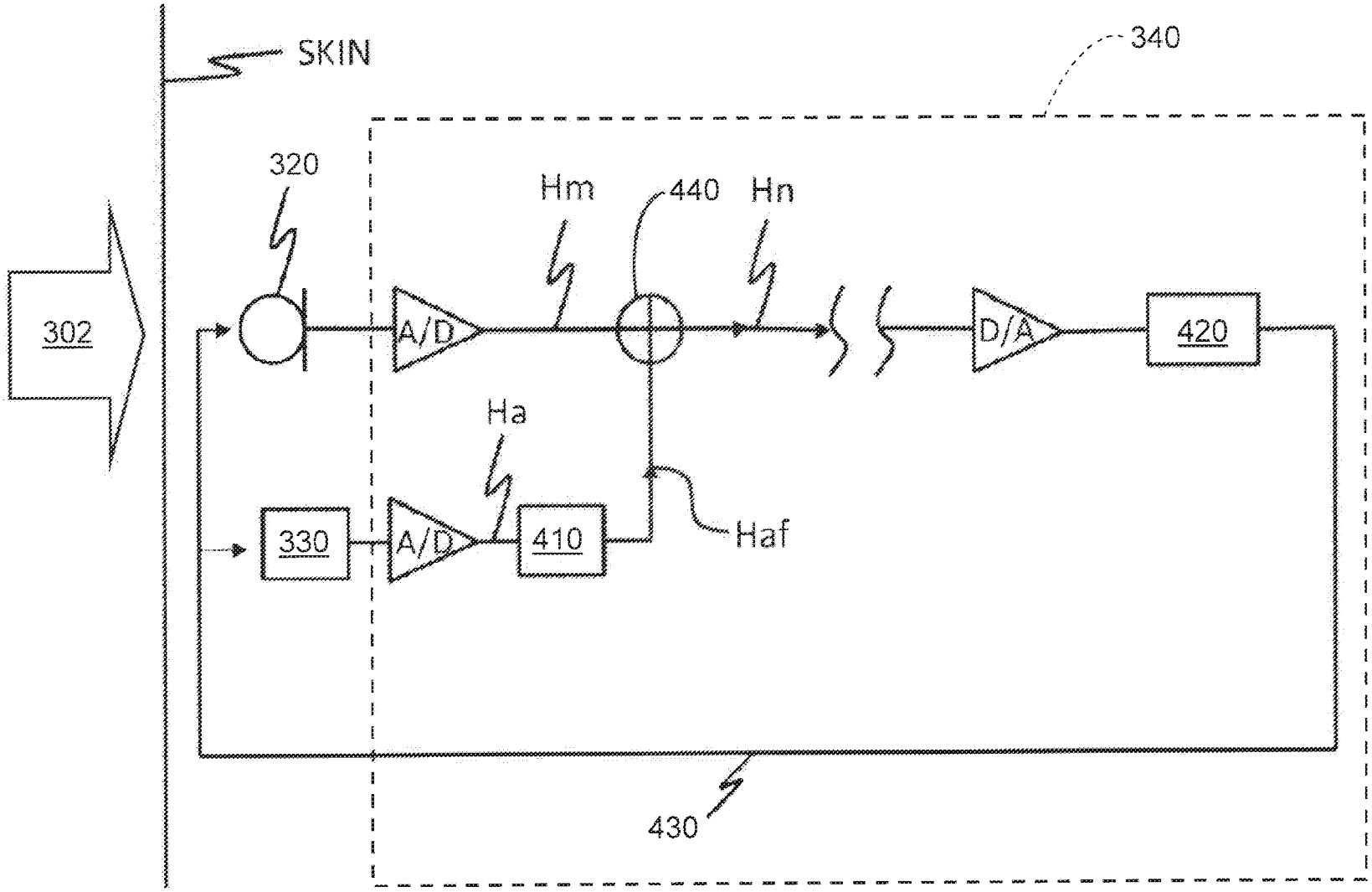
FIG. 4 schematically illustrates example gain circuitry in accordance with certain embodiments described herein.

FIG. 4 schematically illustrates example gain circuitry 340 in accordance with certain embodiments described herein. As shown in FIG. 4, the example gain circuitry 340 of the assembly 300 further comprises a filter 410 that is configured to match the output response Ha of the at least one motion sensor 330 to the output response Hm of the at least one acoustic transducer 320. The at least one acoustic transducer 320 is subject to desired acoustic signals (e.g., ambient sound 302), as well as undesired signals from biological sources (e.g., vibration caused by talking, chewing, etc.) and, depending on the type of stimulation device 420 (e.g., electrode array 146 of acoustic prosthesis 100; actuator 210 of acoustic prosthesis 200; bone conduction actuator; DACI actuator), feedback from the stimulation device 420 received by a tissue feedback loop 430. In certain embodiments, the at least one motion sensor 330 is substantially isolated (e.g., totally isolated) from the ambient acoustic signals 302 received from the ambient source and is subjected to only the undesired signals caused by the biological source and/or by feedback received via the feedback loop 430. Accordingly, the output of the at least one motion sensor 330 corresponds to the undesired signal components of the at least one acoustic transducer 320. However, the magnitude of the output channels (e.g., the output response Hm of the at least one acoustic transducer 320 and the output response Ha of the at least one motion sensor 330) can be different and/or shifted in phase and/or have a shifted frequency response. To remove the undesired signal components from the acoustic transducer output response Hm, the filter 410 and/or the system processor 360 can be operative to filter one or both of the responses to provide scaling, phase shifting and/or frequency shaping to generate the filtered output response Haf. The output response Hm of the at least one acoustic transducer 320 and the filtered output response Haf of the at least one motion sensor 330 are then combined by summation unit 440, which generates a net output response Hn that has a reduced response to the undesired signals, at least if the filter 410 has the correct response.

To implement a filter 410 for scaling and/or phase shifting the output response Ha of the at least one motion sensor 330 to remove the effects of feedback and/or biological noise from a microphone output response Hm, a system model of the relationship between the output responses of the at least one acoustic transducer 320 and the at least one motion sensor 330 is identified/developed. That is, the filter 410 can be operative to manipulate the output response Ha of the at least one motion sensor 330 to biological noise and/or feedback, to replicate the output response Hm of the at least one acoustic transducer 320 to the same biological noise and/or feedback. In this regard, the filtered output response Haf and the acoustic transducer output response Hm may be of substantially the same magnitude and phase prior to combination (e.g., subtraction/cancellation). However, such a filter 410 need not manipulate the output response Ha of the at least one motion sensor 330 to match the acoustic transducer output response Hm for all operating conditions. Rather, the filter 410 can match the output responses Ha and Hm over a predetermined set of operating conditions including, for example, a desired frequency range (e.g., an acoustic hearing range) and/or one or more pass bands. The filter 410 can accommodate the ratio of the acoustic transducer output response Hm to the output response Ha of the at least one motion sensor 330 to acceleration, and thus any changes of the feedback path which leave the ratio of the responses to acceleration unaltered have little or no impact on good cancellation. Such an arrangement thus can have significantly reduced sensitivity to the posture, clenching of teeth, etc., of the recipient.

Figure 5:
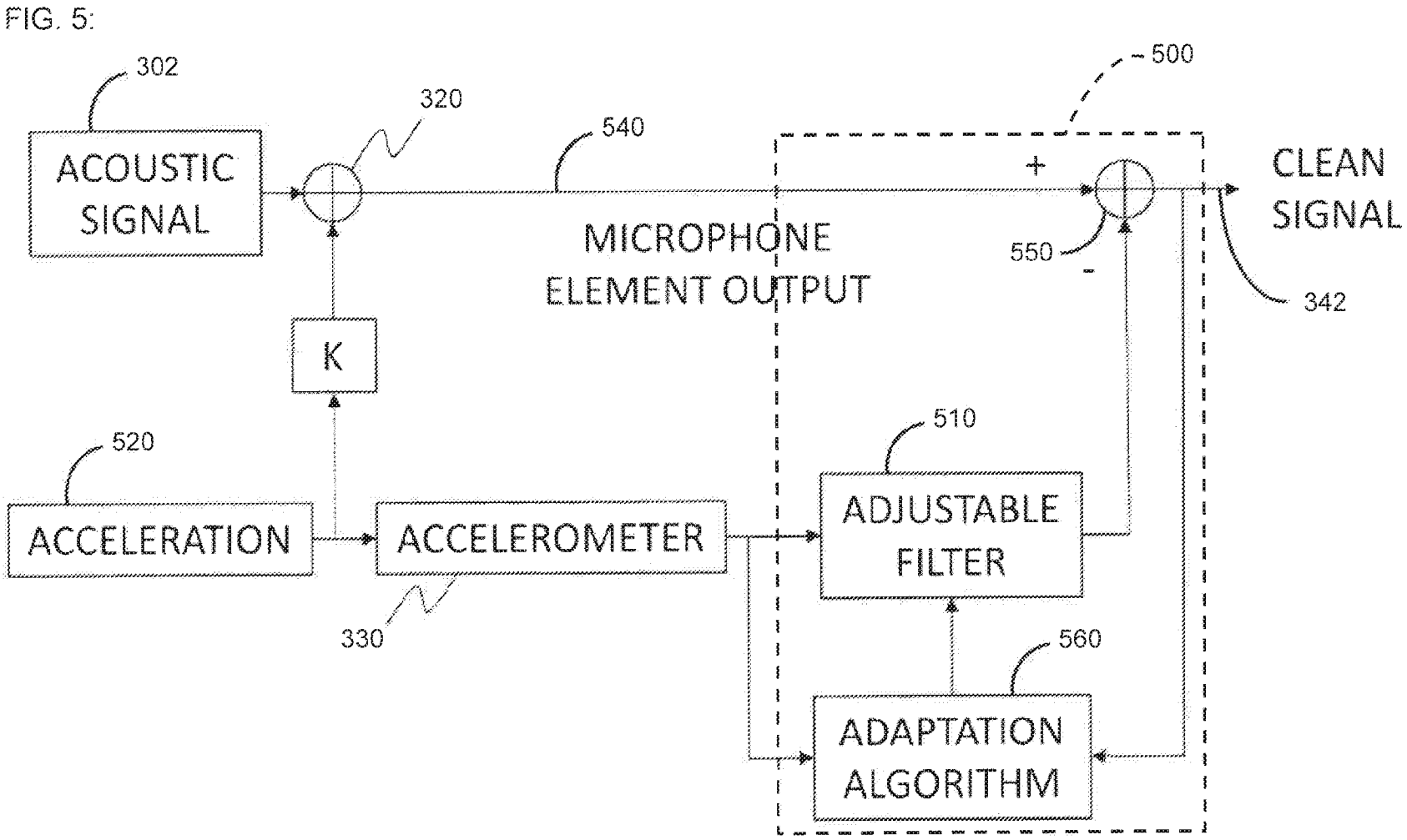
FIG. 5 schematically illustrates an example filter circuit in accordance with certain embodiments described herein.

FIG. 5 schematically illustrates an example filter circuit 500 in accordance with certain embodiments described herein. The example filter circuit 500 of FIG. 5 utilizes one or more adjustable filters 510, such as, by way of example only and not by way of limitation, one or more adaptive filters configured to filter out body noise and the like (e.g., least-mean-square (LMS) adaptive filters; normalized least-mean-square (NLMS) adaptive filters; recursive least square (RLS) adaptive filters; filters working in the time-domain, frequency-domain, or through any filterbanks) More particularly, FIG. 5 functionally illustrates an exemplary use of such adaptive filters. Other embodiments can be implemented using adjustable filters 510 that are not adaptive filters. Any filtering configuration can enable the teachings detailed herein and/or variations thereof to be practiced can be utilized in at least some embodiments.

In FIG. 5, biological noise is modeled by the acceleration 520 at the at least one acoustic transducer 320 filtered through a linear process K. This signal is added to the acoustic signal 302 received by the at least one acoustic transducer 320. In this regard, the at least one acoustic transducer 320 sums the signals to produce the microphone element output signal 540. If the combination of K and the acceleration are known, the combination of the accelerometer output and the adaptive/adjustable filter 510 can be adjusted to be K. This is then subtracted out of the microphone element output 540 at the adder 550. This will result in the net audio signal (e.g., cleansed or clean signal) with a reduced biological noise component. This net audio signal may then be passed to the at least one processor 360 where it can be processed by the auditory prosthesis.

The adjustable filter 510 of certain embodiments is controlled by the at least one processor 360 running an adaptation algorithm 560 to control the adjustable filter 510. The output of the adjustable filter 510, controlled by the control unit running the adaptation algorithm 560, is fed to adder 550, wherein it is added to (or, more accurately, subtracted from) the microphone element output signal 540, and the resultant signal 342 is transmitted to a signal processor and/or a stimulation device of the auditory prosthesis (e.g., auditory prosthesis 100; auditory prosthesis 200). Collectively, the at least one motion sensor 330, the adjustable filter 510, the at least one processor 360, and the adder 550 correspond to an adaptive noise cancellation sub-system. The at least one processor 360 runs the adaptation algorithm 560 to control the adjustable filter 510 based on, for example, at least in part, feedback of the signal outputted by the adder 550. When used to filter out body noise, the example filter circuit 500 can operate with a relatively short time constant (e.g., less than one second; less than 0.5 second; less than 250 milliseconds). Various example configurations for filtering the output of an implantable microphone that are compatible with certain embodiments described herein are described by U.S. Pat. No. 8,840,540 and U.S. Publ. Pat. Appl. No. 2016/0345107.

An acoustic transducer (e.g., microphone) translates received real sound pressure into an electrical signal. The relationship between the real sound pressure and the electrical signal can mathematically be expressed as an acoustic response function of the acoustic transducer. In other words, the acoustic response function describes the acoustic transducer output signals (e.g., electrical voltage) as a function of the sound input. Thus, the output electrical signals from the acoustic transducer are indicative of the input sound signals received by the acoustic transducer, with the acoustic response function providing the relationship between the sound input and the electrical output.

The acoustic response function is affected by the ambient pressure and any ambient pressure differential across a microphone membrane of the acoustic transducer. In an ordinary microphone device having a purge hole, the ambient pressure on each side of the membrane is equalized. This ambient pressure compensation negates any pressure difference and removes any effect on the acoustic response function. Hence, ordinarily the acoustic response function for a particular acoustic transducer can be derived during calibration of the acoustic transducer.

Figure 6:
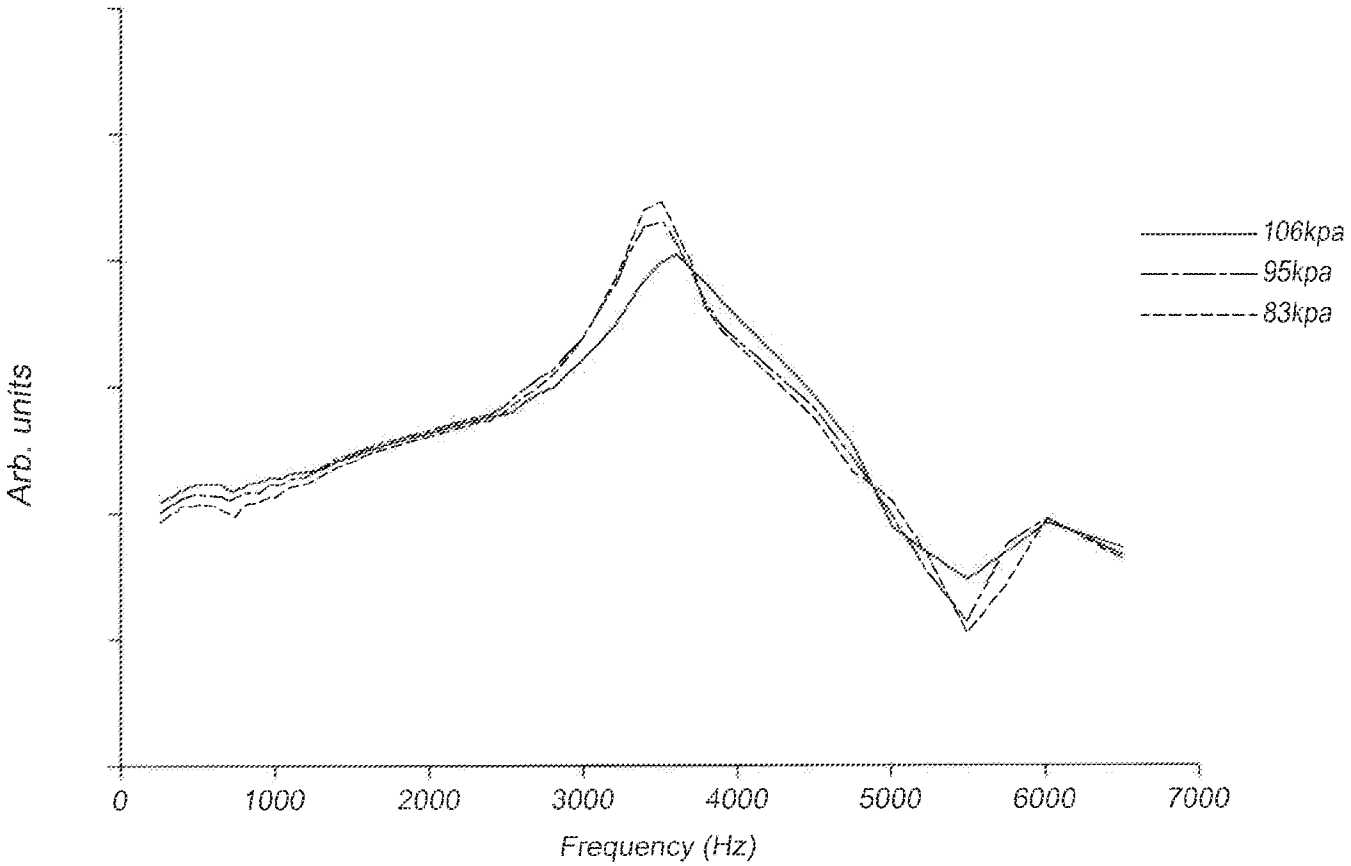
FIG. 6 shows the acoustic response functions for an acoustic transducer of an example implantable assembly while exposed to three different external atmospheric pressures in accordance with certain embodiments described herein.

Implantable assemblies are generally hermetically sealed devices for which a purge hole cannot be used to equalize ambient pressure across the microphone membrane of the acoustic transducer. As a result, the inner pressure cannot change in response to changes of the outside pressure, and the resultant variations in static and dynamic pressure difference across the membrane affect the acoustic response function of the acoustic transducer. Thus, auditory prostheses which do not take into account the effects of external pressure changes on the implantable assemblies can result in a loss of accuracy in determining actual sound pressure input. For example, portions of the automatic gain control (AGC), such as knee point portions, applied to the transducer output signals 322 in generating the microphone assembly output signals 342 can be wrong (e.g., too high or too low), making the feedback path of the adjustable filter 510 more unstable and thereby reducing the performance of the acoustic prosthesis 100, 200. FIG. 6 shows the acoustic response functions for an acoustic transducer 320 of an example implantable assembly 300 while exposed to three different external atmospheric pressures in accordance with certain embodiments described herein. FIG. 6 illustrates the effects of changing external atmospheric pressure on the acoustic response s of implanted assemblies. The acoustic response functions of FIG. 6 were measured under conditions in which the assembly 300 was not implanted in a recipient, but was contained in a chamber in which the pressure external to the assembly 300 could be controlled and adjusted. By virtue of the acoustic transducer 320 being placed under the skin and having a custom diaphragm, the acoustic response function of the acoustic transducer 320 is not flat (e.g., the acoustic response function is not constant across all frequencies).

The acoustic transducer 320 exhibits different acoustic response functions at the different external atmospheric pressures. For example, at about 3.4 kHz, there is a difference between the acoustic response function at 83 kPa and the acoustic response function at 106 kPa. However, across the same frequency range, the acoustic response functions of the motion sensor 330 (e.g., accelerometer)(not shown) across this same range of external atmospheric pressures do not differ appreciably from one another, and any differences appear to be due to noise. To be implantable, the assembly 300 is hermetically sealed, so the air inside the acoustic chamber of the acoustic transducer 320 is compressed by the additional atmospheric pressure on the diaphragm which affects the acoustic response function of the acoustic transducer 320. However, the motion sensor 330 has no diaphragm, so it is substantially unaffected or minimally affected by the change of the external pressure. Despite calibration of the assembly 300 performed before being implanted into the recipient and further calibration performed during a fitting procedure once implanted into a recipient, these changes of the acoustic response function due to changing environmental conditions (e.g., external pressure; skin flap thickness) can result in sub-optimal performance of the assembly. Certain embodiments described herein advantageously correct for these differences of the acoustic response function, thereby providing more accurate hearing to the recipient.

Figure 7A:
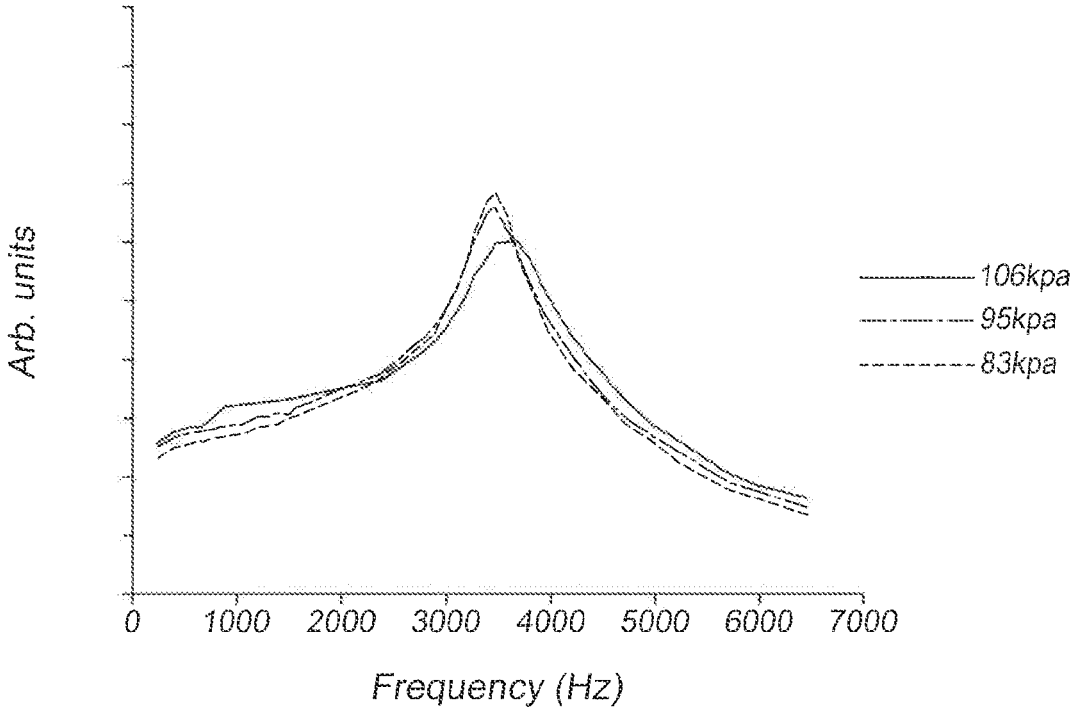
FIGS. 7A and 7B show the vibration response functions for an acoustic transducer and a motion sensor, respectively, of an example implantable assembly while exposed to three different external atmospheric pressures in accordance with certain embodiments described herein.
Figure 7B:
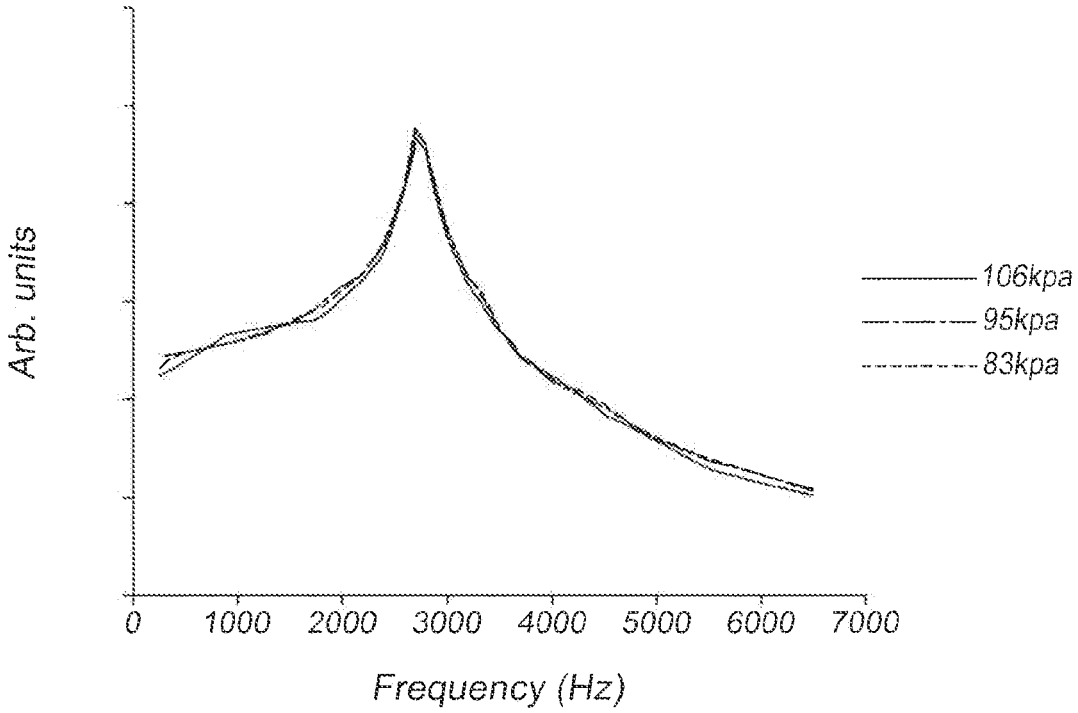

FIGS. 7A and 7B show the vibration response functions for an acoustic transducer 320 and a motion sensor 330, respectively, of an example implantable assembly 300 while exposed to three different external atmospheric pressures in accordance with certain embodiments described herein. The vibration response functions of FIGS. 7A and 7B were measured under conditions in which the assembly 300 was not implanted in a recipient, but was contained in a chamber in which the pressure external to the assembly 300 could be controlled and adjusted. The acoustic transducer 320 exhibits different vibration response functions at the different external atmospheric pressures. For example, at 3.4 kHz, there is a difference between the vibration response function at 83 kPa and the vibration response function at 106 kPa. However, across the frequency range of FIG. 7B, the vibration response functions of the motion sensor 330 (e.g., accelerometer) do not differ appreciably from one another.

Figure 8A:
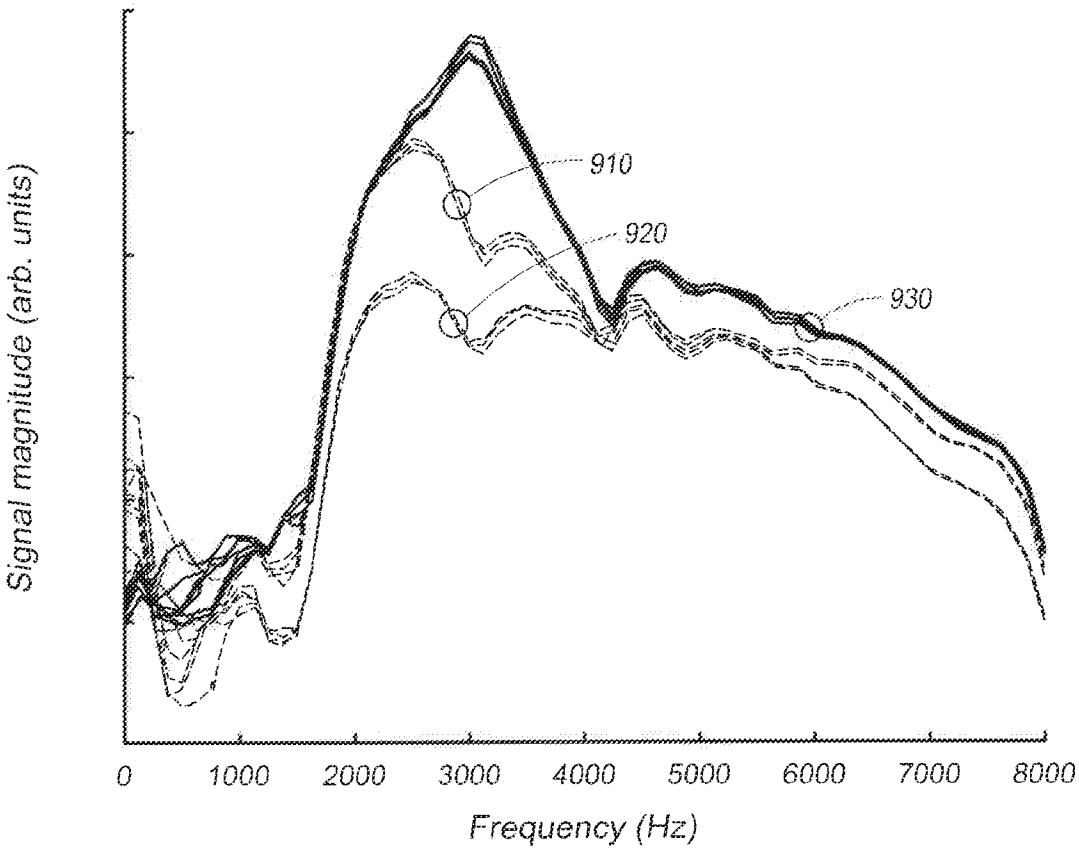
FIG. 8A shows the vibration response functions for an acoustic transducer and the vibration response functions for a motion sensor of an example implantable assembly while exposed to two different external atmospheric pressures in accordance with certain embodiments described herein.
Figure 8B:
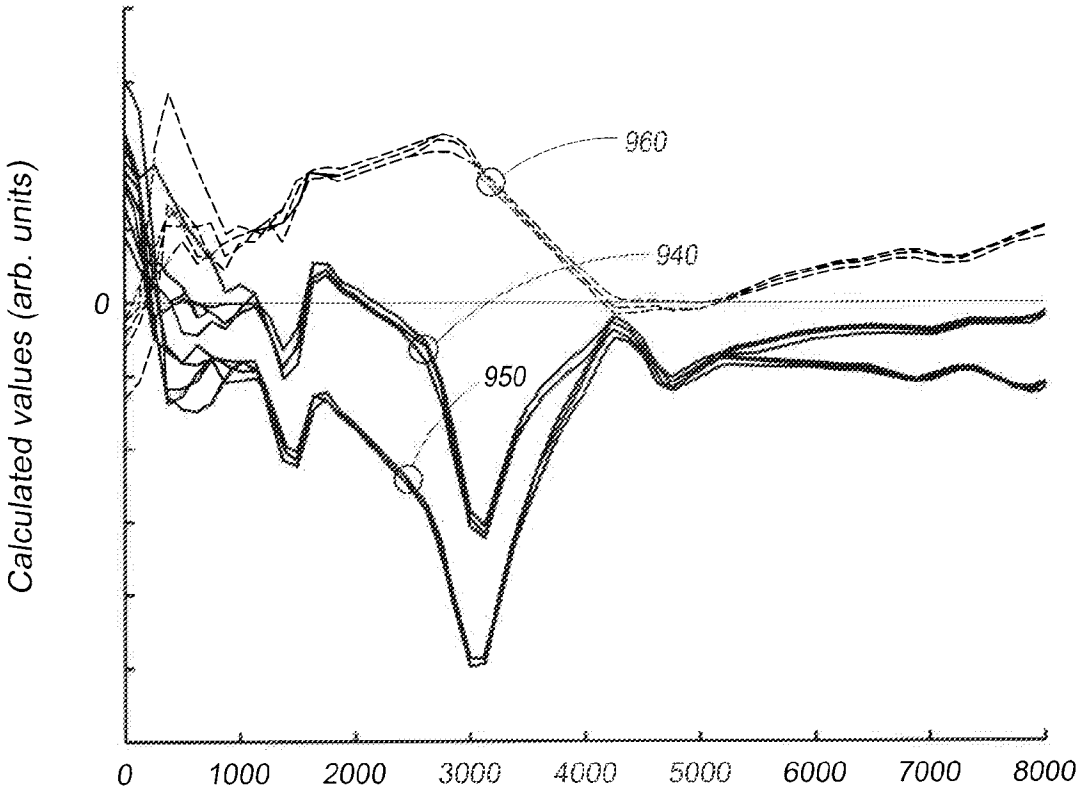
FIG. 8B shows the vibration response functions of the acoustic transmitter at the two altitudes, as shown in FIG. 8A, normalized using the vibration response function of the motion sensor at the two altitudes in accordance with certain embodiments described herein.

FIGS. 8A and 8B show that these features of the acoustic response function and the vibration response function of the acoustic transducer 320 and motion sensor 330 also exist for assemblies 300 that are implanted in the recipient's head. FIG. 8A shows the vibration response functions (e.g., $VRF_{mic}$) for an acoustic transducer 320 and the vibration response functions (e.g., $VRF_{acc}$) for a motion sensor 330 of an example implantable assembly 300 while exposed to two different external atmospheric pressures in accordance with certain embodiments described herein. The assembly 300 of FIG. 8A was implanted in a recipient as a component of a fully implantable middle-ear acoustic prosthesis. The vibrations were generated using the actuator of the middle-ear acoustic prosthesis.

Data plots 910 of FIG. 8A are positional noise measurements which show the $VRF_{mic}$ while the recipient was at a first altitude and with the recipient's head at five different positions (up, down, left, right, center). Data plots 920 of FIG. 8A are positional noise measurements which show the $VRF_{mic}$ while the recipient was at a second altitude and with the recipient's head at the same five different positions. Data plots 930 of FIG. 8A are positional noise measurements which show the $VRF_{acc}$ while the recipient was at the first altitude and while the recipient was at the second altitude, with the recipient's head at the same five different positions.

The first altitude and the second altitude differed from one another (e.g., by more than 500 meters), and corresponded to different external atmospheric pressures applied to the implanted assembly 300. As can be seen in FIG. 8A, except for the vibration frequency range of about 4.1 kHz to about 5 kHz, $VRF_{mic}$ 910 exhibits differences from $VRF_{mic}$ 920. There are no appreciable differences, except for noise at frequencies below 1 kHz, between the plots of $VRF_{acc}$ 930 across most of the frequency range (about 1 kHz to about 8 kHz).

FIG. 8B shows the vibration response functions of the acoustic transmitter 320 at the two altitudes, as shown in FIG. 8A, normalized using the vibration response function of the motion sensor 300 at the two altitudes in accordance with certain embodiments described herein. Data plots 940 of FIG. 8B show the data plots 910 normalized (e.g., divided) by the data plots 930 (e.g., $VRF_{mic}/VRF_{acc}$). Data plots 950 of FIG. 8B show the data plots 920 normalized (e.g., divided) by the data plots 930 (e.g., $VRF_{mic}/VRF_{acc}$). Data plots 960 of FIG. 8B show the differences between the data plots 940 and the data plots 950.

As can be seen in FIGS. 8A and 8B, there is little variation of the vibration response function of the acoustic transducer 320 for the different positions of the recipient's head, but there are large differences between the vibration response functions of the acoustic transducer 320 for different external atmospheric pressures of the different altitudes. Generally, variations of the position of the recipient's head occur on a relatively fast time scale (e.g., seconds), while variations of the external atmospheric pressure occur on a relatively longer time scale (e.g., minutes; hours; days). In certain embodiments, as described more fully herein, the measured vibration response function of the acoustic transducer 320 are time-averaged over a time period (e.g., minutes; hours; days) that is longer than the time scale for variations of the position of the recipient's head. In certain embodiments, as described more fully herein, differences between measured vibration response functions of the acoustic transducer 320 are used as being indicative of changes of the acoustic response function of the acoustic transducer 320 due to changes of the external atmospheric pressure applied to the acoustic transducer 320. In certain such embodiments, the measured vibration response function of the acoustic transducer 320 is used to deduce the change of the acoustic response function of the acoustic transducer 320 and, in response to the measured vibration response function, the calibration (e.g., gain values applied to the transducer output signals by automatic gain control circuitry) of the acoustic transducer 320 is updated (e.g., modified) as appropriate.

Figure 9:
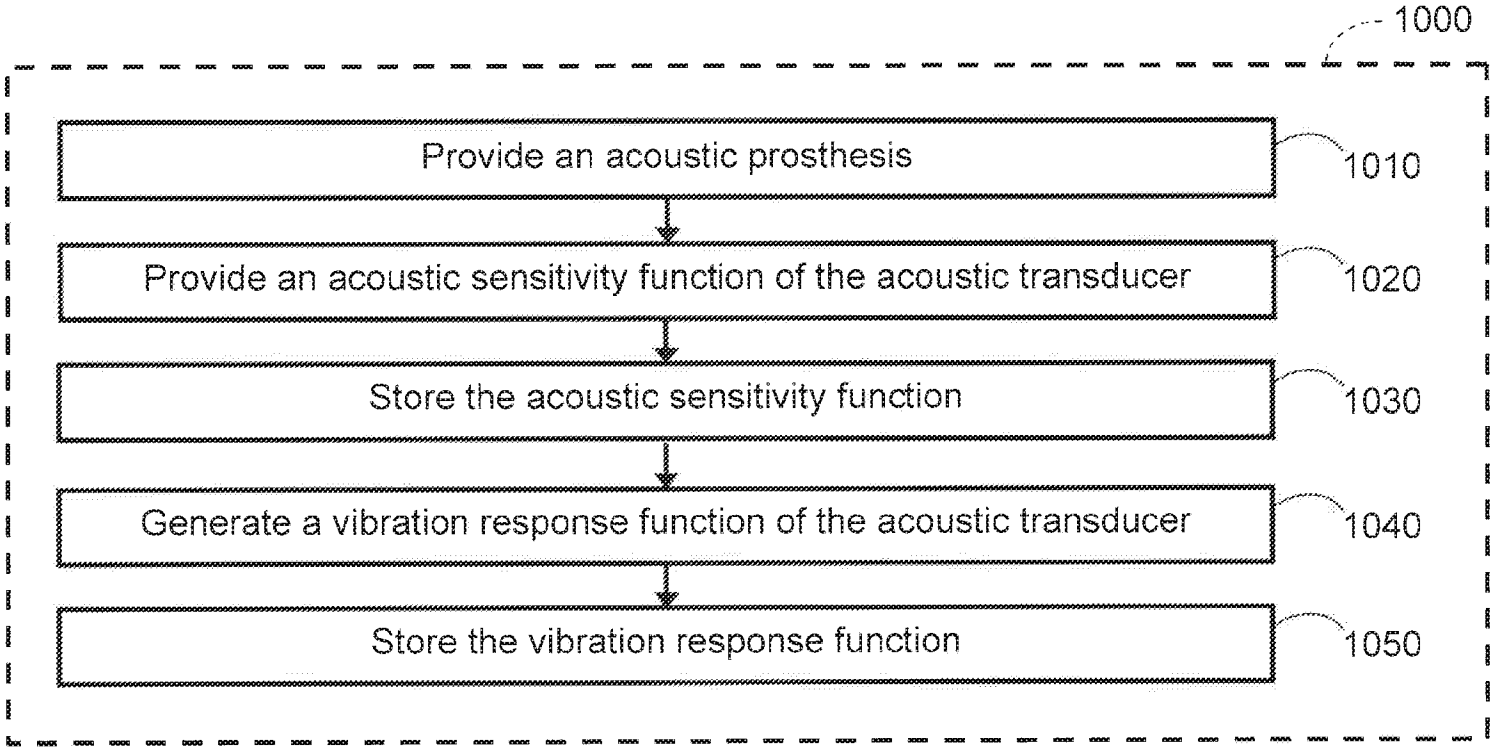
FIG. 9 is a flow diagram of an example method in accordance with certain embodiments described herein.
Figure 10:
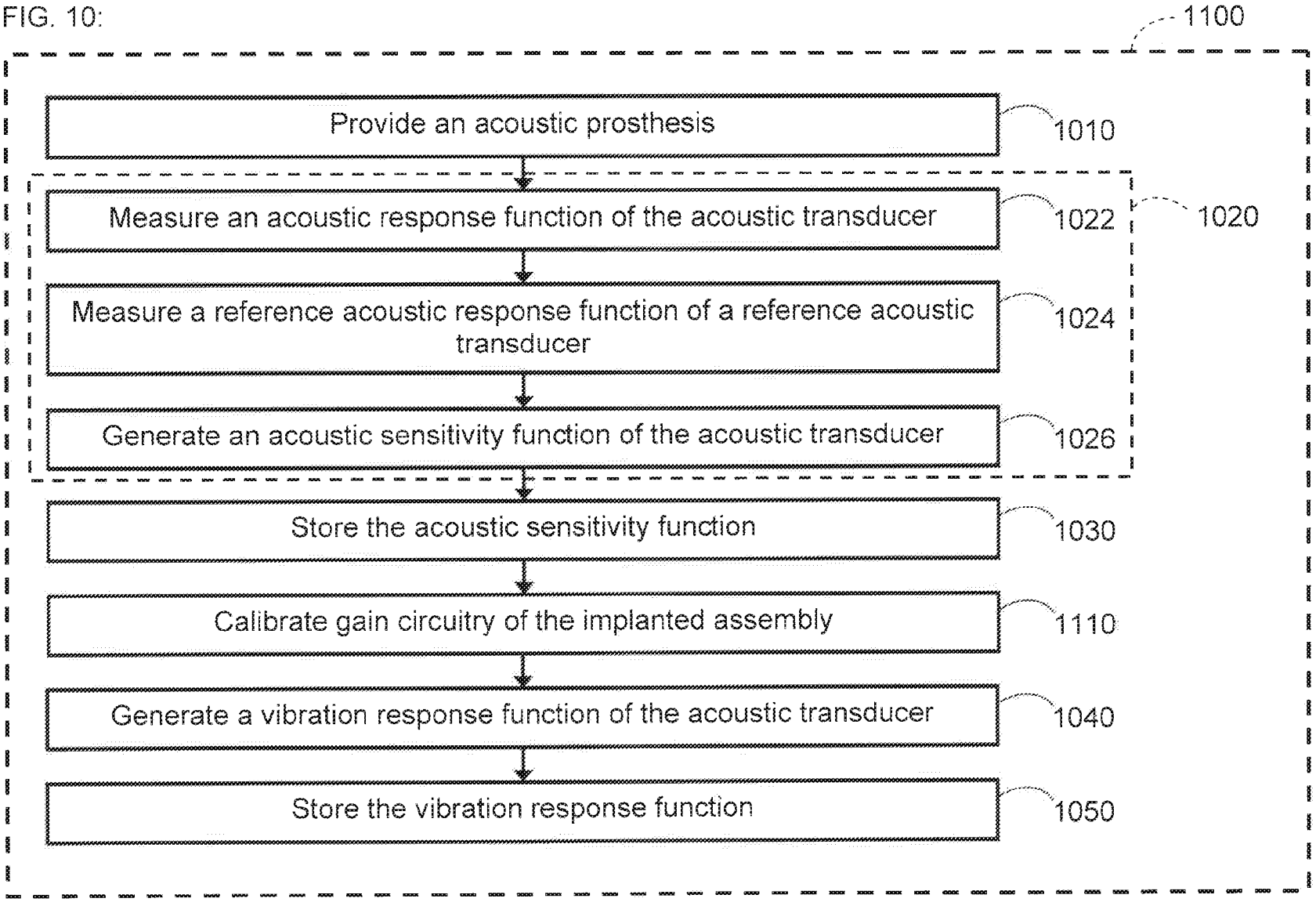
FIG. 10 is a flow diagram of another example method in accordance with certain embodiments described herein.

FIG. 9 is a flow diagram of an example method 1000 in accordance with certain embodiments described herein. FIG. 10 is a flow diagram of another example method 1100 in accordance with certain embodiments described herein. Each of the example methods 1000, 1100 can be performed as part of or concurrently with a fitting procedure in which the acoustic prosthesis 100, 200 is controlled by a healthcare professional (e.g., an acoustic prosthesis technician) to calibrate the implanted assembly 300 for use by the recipient. While the methods 1000, 1100 are described herein by referring to the example acoustic prostheses 100, 200 of FIGS. 1 and 2 and to the example assembly 300 of FIGS. 3A and 3B, other acoustic prostheses and other implantable assemblies are also compatible with being used with the methods 1000, 1100 in accordance with certain embodiments described herein.

Figure 11:
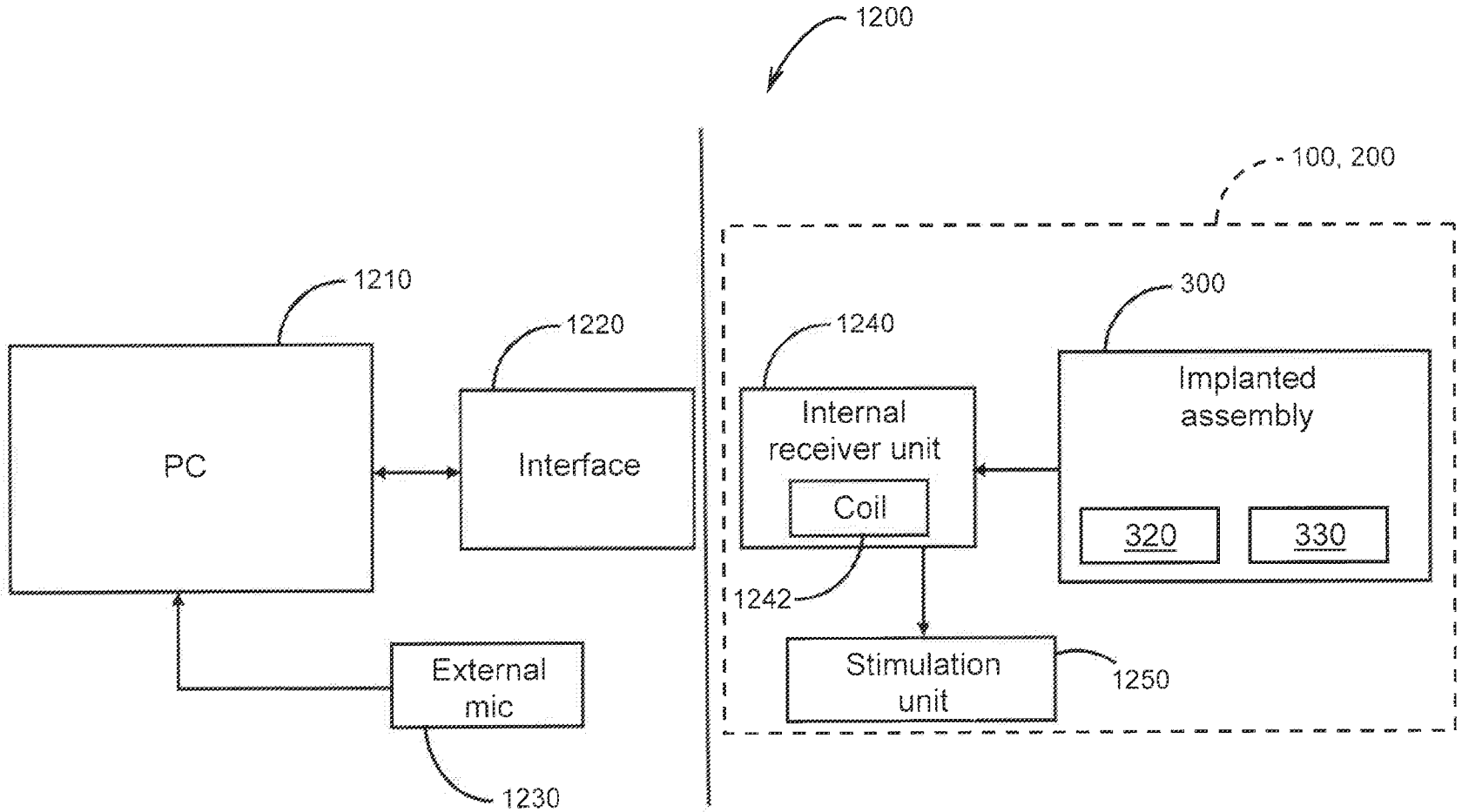
FIG. 11 schematically illustrates an example configuration compatible for performing the example methods of FIGS. 9 and 10 in accordance with certain embodiments described herein.

FIG. 11 schematically illustrates an example configuration 1200 compatible for performing the example methods 1000, 1100 of FIGS. 9 and 10 in accordance with certain embodiments described herein. The configuration 1200 comprises a personal computer (PC) 1210 in operative communication (e.g., wirelessly or wired) with an interface 1220 and an external microphone 1230. The PC 1210, the interface 1220, and the external microphone 1230 are configured for use during the fitting procedure and the methods 1000, 1100, but are not configured for use during normal operation of the acoustic prosthesis 100, 200. The interface 1220 (e.g., a sound processor unit for an acoustic prosthesis 100 comprising a cochlear implant device) is in wireless radio-frequency (RF) communication with a coil 1242 of an implanted internal receiver unit 1240 in operative communication with the implanted assembly 300 and with a stimulation unit 1250 (e.g., a stimulator unit 120 for an acoustic prosthesis 100 comprising a cochlear implant device; an actuator 210 for an acoustic prosthesis 200 comprising a middle ear implant). The PC 1210 can then communicate with the internal receiver unit 1240 and control one or both of the implanted assembly 300 and the stimulator unit 1250, and can receive output signals from the implanted assembly 300 and from the external microphone 1230. In certain embodiments, the methods 1000, 1100 are performed while using the configuration 1200 during a fitting procedure to configure the acoustic prosthesis 100, 200 for proper operation.

In an operational block 1010, each of the methods 1000, 1100 comprises providing an acoustic prosthesis 100, 200 comprising an assembly 300 implanted within the body of a recipient. The implanted assembly 300 comprises an acoustic transducer 320 and a motion sensor 330. For example, the acoustic prosthesis 100, 200 can include a cochlear implant device, middle ear implant device, bone conduction device (e.g., active transcutaneous bone conduction device), Direct Acoustic Cochlear Implant (DACI), and/or combinations or variations thereof.

In an operational block 1020, each of the methods 1000, 1100 further comprises providing an acoustic sensitivity function ("$ASF_{mic}$") of the acoustic transducer 320 to acoustic signals having a first range of frequencies. FIG. 11 shows an example of providing the $ASF_{mic}$ of the acoustic transducer 320 in the operational block 1020.

In an operational block 1022, providing the $ASF_{mic}$ of the acoustic transducer 320 in the operational block 1020 comprises measuring an acoustic response function ("$ARF_{mic}$") of the acoustic transducer 320 to acoustic signals having a first range of frequencies. For example, the output signals from the acoustic transducer 320 can be measured while acoustic signals having the first range of frequencies are detected by the acoustic transducer 320. The first range of frequencies can span the range of acoustic frequencies that the acoustic prosthesis 100, 200 is expected to perform or can span only a portion of this range of acoustic frequencies. For example, the first range of frequencies can span a range of acoustic frequencies across an audible range (e.g., between 100 Hz and 10 kHz for adults; up to 20 kHz for children) or can span only a portion of the audible range (e.g., 1 kHz to 8 kHz; 1 kHz to 10 kHz; 1 kHz to 20 kHz). Some recipients of the acoustic prostheses described herein retain so-called residual hearing. For instance, adults often experience high frequency hearing loss before other hearing loss, and for some such recipients, natural hearing in at least part of their residual hearing range is ideal. Thus the first range of frequencies for such recipients can exclude at least some of the recipient's residual hearing range. As an individual's residual hearing changes (e.g., diminishes) over time, the first range of frequencies can be revised to include a progressively broader range of frequencies.

In an operational block 1024, providing the $ASF_{mic}$ of the acoustic transducer 320 in the operational block 1020 further comprises measuring a reference acoustic response function ("$ARF_{ref}$") of a reference acoustic transducer to acoustic signals having the first range of frequencies. For example, the output signals from the reference acoustic transducer can be measured while acoustic signals having the first range of frequencies are detected by the reference acoustic transducer. The reference acoustic transducer can comprise the external microphone 1230 of FIG. 11, which is positioned externally to the recipient (e.g., behind the recipient's ear; spaced from the recipient's ear; off the recipient's ear). The reference external microphone 1230 can be calibrated and can provide output signals that are indicative of the acoustic signals received by the reference external microphone 1230.

To measure one or both of $ARF_{mic}$ and $ARF_{ref}$ in the operational blocks 1022 and 1024, the PC 1210 can be in operative communication with a speaker (e.g., a loudspeaker configured to emit acoustic signals detectable by both the implanted assembly 300 and the external microphone 1230) positioned externally to the recipient (e.g., in front of, or at an angle to, the recipient). The PC 1210 can be configured to control the speaker to emit acoustic signals having the first range of frequencies (e.g., white noise) which are detected by both the implanted microphone assembly 300 and the external microphone 1230, and in the operational blocks 1022 and 1024, the output signals from the implanted assembly 300 and the external microphone 1230 can be received by the PC 1210 and used to compute $ARF_{mic}$ and $ARF_{ref}$ (e.g., in decibels per frequency bin from a fast Fourier transform of the output signals). In certain embodiments, noise floor levels can be measured for one or both of the implanted assembly 300 and the external microphone 1230 while the acoustic transducer 320 and the reference external microphone 1230 are not exposed to acoustic signals generated externally to the recipient (e.g., measurements of the noise floor levels can be made with the speaker turned off and measuring the output signals due to ambient noise). The noise floor measurements can be compared to the measurements taken while the speaker is turned on to ensure that the speaker is providing white noise of sufficient magnitude (e.g., per frequency bin or globally) to perform the method 1000.

In certain embodiments, measuring $ARF_{mic}$ and $ARF_{ref}$ are performed concurrently with one another (e.g., receiving the output signals from the implanted assembly 300 concurrently with receiving the output signals from the external microphone 1230), while in certain other embodiments, measuring $ARF_{mic}$ and $ARF_{ref}$ are performed sequentially to one another (e.g., running the speaker and receiving the output signals from the implanted assembly 300 then running the speaker again and then receiving the output signals from the external microphone 1230). During the operational blocks 1022 and 1024, the stimulation unit 1250 of the acoustic prosthesis 100, 200 can be temporarily disabled (e.g., turned off) to avoid undue discomfort to the recipient.

In an operational block 1026, in response to the measured $ARF_{mic}$ and $ARF_{ref}$, providing the $ASF_{mic}$ of the acoustic transducer 320 in the operational block 1020 further comprises generating an $ASF_{mic}$ of the acoustic transducer 320 to acoustic signals having the first range of frequencies. For example, $ASF_{mic}$ can be generated in response to a ratio of the measured acoustic response function of the external microphone 1230 and the measured acoustic response function of the implanted assembly 320 (e.g., $ASF_{mic}=ARF_{ref}$ $ARF_{mic}$). The acoustic sensitivity function $ASF_{mic}$ provides a calibration function to be used in determining the gain to be applied to the output signals from the implantable assembly 300 so as to provide assembly output signals that mimic output signals expected from the calibrated external microphone 1230.

In an operational block 1030, each of the methods 1000, 1100 further comprises storing the acoustic sensitivity function $ASF_{mic}$ in a storage device (e.g., storage device 350 of FIGS. 3A and 3B) of the implanted assembly 300. In an operational block 1110, the method 1100 further comprises calibrating gain circuitry 340 of the implanted assembly 300 in response to the acoustic sensitivity function $ASF_{mic}$. For example, during a fitting procedure in which the $ASF_{mic}$ is generated, the gain circuitry 340 of the implantable assembly 300 can be calibrated in response to the $ASF_{mic}$. By storing $ASF_{mic}$, certain embodiments provide the implanted assembly 300 with the calibration function to be used during normal operation.

In an operational block 1040, each of the methods 1000, 1100 further comprises generating a vibration response function ("$VRF_{mic}$") of the acoustic transducer 320 to vibrations having a second range of frequencies. The second range of frequencies can span the range of vibration frequencies that the acoustic prosthesis 100, 200 is expected to perform or can span only a portion of this range of vibration frequencies. For example, the second range of frequencies can span a range of vibration frequencies between 100 Hz and 10 kHz, between 100 Hz and 20 kHz, between 1 kHz and 8 kHz; between 1 kHz and 10 kHz; between 1 kHz and 20 kHz.

In certain embodiments, generating the $VRF_{mic}$ comprises applying vibrations having the second range of frequencies to the implanted assembly 300, measuring transducer output signals from the acoustic transducer 320 while applying the vibrations, and measuring sensor output signals from the motion sensor 330 while applying the vibrations. For example, the output signals from the acoustic transducer 320 and the output signals from the motion sensor 330 can be measured by a body noise cancellation adaptive/adjustable filter of the implanted assembly 300 (e.g., filter circuit 500 configured for body noise cancellation; least-mean-square (LMS) adaptive filter; normalized least-mean-square (NLMS) adaptive filter; recursive least square (RLS) adaptive filter; filter working in the time-domain, frequency-domain, or through any filterbanks) For another example, the output signals from the acoustic transducer 320 and the output signals from the motion sensor 330 can be received by circuitry dedicated solely to generating the $VRF_{mic}$ (e.g., operating in parallel with a body noise cancellation adaptive/adjustable filter of the implanted assembly 300).

In certain embodiments, the transducer output signals generated while the vibrations are received by the implantable assembly 300 and the sensor output signals generated while the vibrations are received by the implantable assembly 300 are time-averaged over a relatively long time period (e.g., greater than one second; greater than 2 seconds; greater than 5 seconds) to generate a long-term average and to reduce variance. In certain embodiments, only transducer output signals and/or sensor output signals above a threshold set to a predefined level are used to generate the $VRF_{mic}$.

In certain embodiments in which the acoustic prosthesis 100 comprises a cochlear implant, the vibrations can be generated by the recipient. For example, the recipient can be asked to speak (e.g., read from a text), move the recipient's head (e.g., among several predetermined positions), and/or to breathe loudly for a period of time (e.g., a few seconds). In certain embodiments in which the acoustic prosthesis 200 comprises a middle ear implant, the vibrations can be generated by the recipient, as for the acoustic prosthesis 100. In certain other embodiments, the vibrations can be generated by the totally implantable actuator 210 of the middle ear implant. In certain such embodiments, the vibrations generated by the actuator 210 include white noise (e.g., maximum length sequence (MLS) noise).

Generating the $VRF_{mic}$ in certain embodiments further comprises, in response to the transducer output signals and the sensor output signals, calculating the vibration response function across the second range of frequencies. For example, the $VRF_{mic}$ can be calculated to be proportional to a ratio of the transducer output signals and the sensor output signals over the second range of frequencies.

In an operational block 1050, each of the methods 1000, 1100 further comprises storing the vibration response function $VRF_{mic}$ in the storage device (e.g., storage device 350 of FIGS. 3A and 3B) of the implanted assembly 300. As described more fully herein, the vibration response function $VRF_{mic}$ can be stored for later use by the implanted assembly 300 as a reference vibration response function of the acoustic transducer 320. The $VRF_{mic}$ can also be used by fitting software to set a prefilter for the body noise cancellation adaptive/adjustable filter of the implanted assembly 300 to increase stability.

Figure 12:
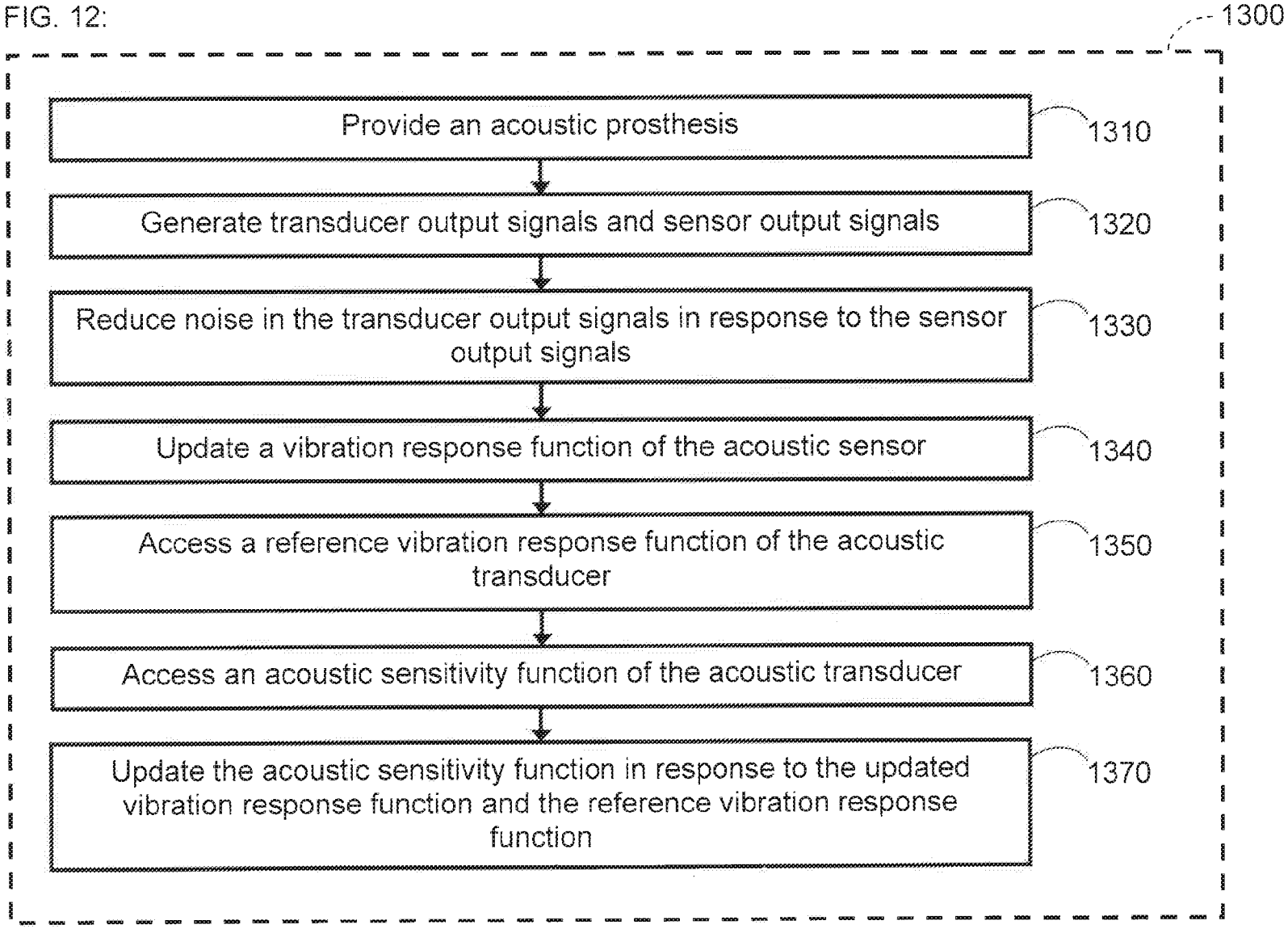
FIG. 12 is a flow diagram of an example method in accordance with certain embodiments described herein.
Figure 13:
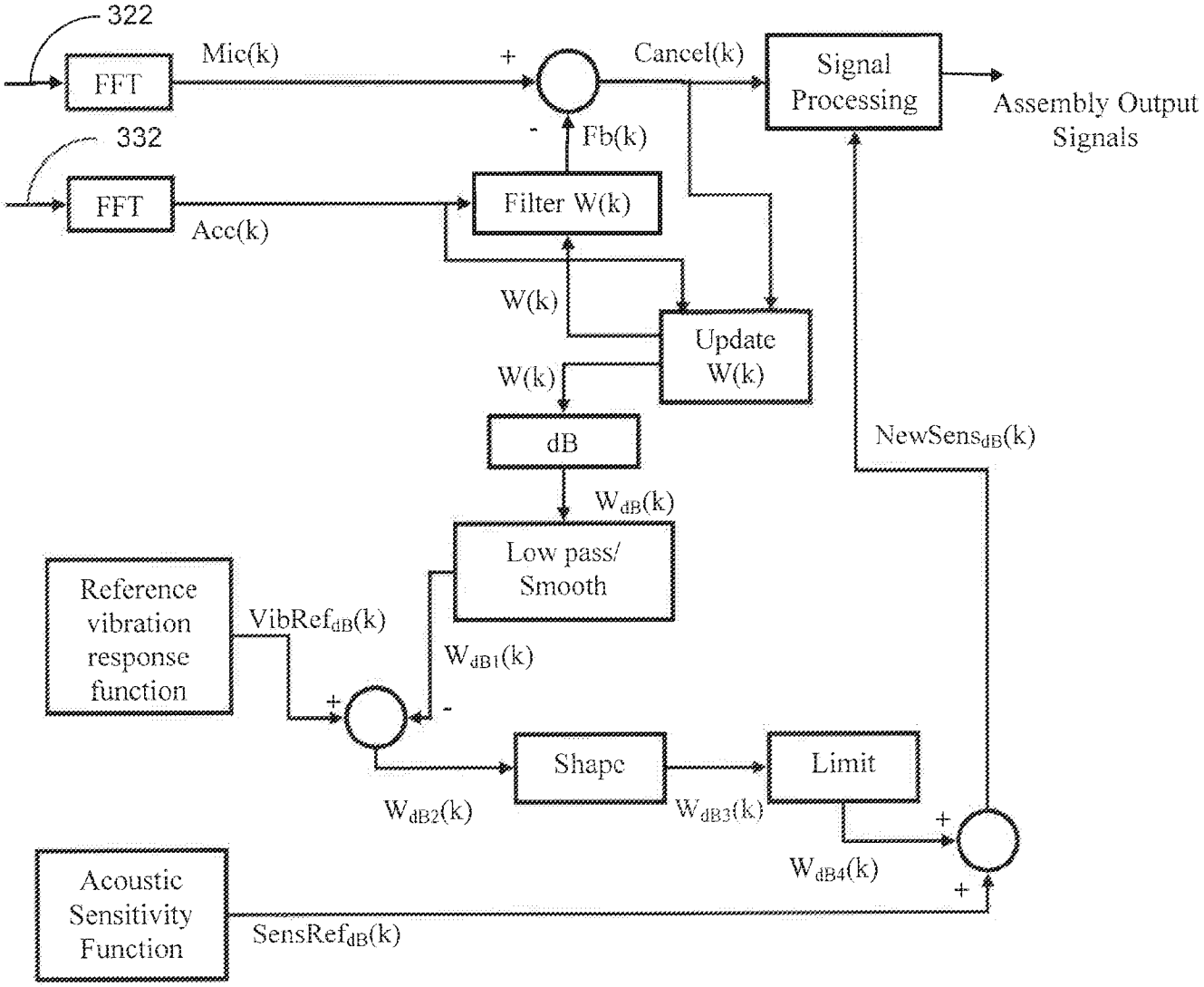
FIG. 13 shows a functional diagram of example circuitry (e.g., controller; microprocessor) of an acoustic prosthesis configured to perform the example method of FIG. 12 during normal operation of the acoustic prosthesis in accordance with certain embodiments described herein.

FIG. 12 is a flow diagram of an example method 1300 in accordance with certain embodiments described herein. FIG. 13 shows a functional diagram of example circuitry 1400 (e.g., controller; microprocessor) of an acoustic prosthesis 100, 200 configured to perform the method 1300 during normal operation of the acoustic prosthesis 100, 200 in accordance with certain embodiments described herein. The method 1300 and circuitry 1400 can be used to improve the performance of the acoustic prosthesis 100, 200 by accounting for changes of the external pressure experienced by the implanted microphone assembly 300 (e.g., due to changes of elevation of the recipient).

For example, as described herein, certain embodiments advantageously utilize a relationship between the dependence of the $ARF_{mic}$ of the acoustic transducer 320 on external pressure and the dependence of the $VRF_{mic}$ of the acoustic transducer 320 on external pressure to modify in situ the output signals from the assembly 300 to account for changes of the $ARF_{mic}$ that are due to changes of the externally applied pressure, so that the stimulation signals of the acoustic prosthesis 100, 200 are more closely indicative of the acoustic signals received by the acoustic transducer 320. While the method 1300 is described herein by referring to the example acoustic prostheses 100, 200 of FIGS. 1 and 2, the example assembly 300 of FIGS. 3A and 3B, and the example circuitry 1400 of FIG. 13, other acoustic prostheses, implantable assemblies, and circuitries are also compatible with being used with the method 1300 in accordance with certain embodiments described herein.

In an operational block 1310, the method 1300 comprises providing an implanted acoustic prosthesis 100, 200 comprising an assembly 300 implanted within the body of a recipient. The implanted assembly 300 comprises an acoustic transducer 320 and a motion sensor 330. For example, the acoustic prosthesis 100, 200 can include a cochlear implant device, middle ear implant device, bone conduction device (e.g., active transcutaneous bone conduction device), Direct Acoustic Cochlear Implant (DACI), and/or combinations or variations thereof. The acoustic transducer 320 is configured to generate transducer output signals 322 and the motion sensor 330 is configured to generate sensor output signals 332.

In an operational block 1320, the method 1300 further comprises generating transducer output signals 322 from the acoustic transducer 320 and sensor output signals 332 from the motion sensor 330. For example, the transducer output signals can be generated by the acoustic transducer 320 in response to acoustic signals and vibrations received by the implanted assembly 300, such that the transducer output signals 322 are indicative of both transcutaneously received acoustic sound and motion. The sensor output signals 332 can be generated by the motion sensor 330 in response to the vibrations received by the implanted assembly 300, such that the sensor output signals 332 are indicative of transcutaneously received motion (e.g., caused by vibration and/or acceleration). As shown in FIG. 14, the transducer output signals 322 and the sensor output signals 332 can undergo a Fast Fourier Transform (FFT) and can be expressed as Mic(k) and Acc(k), respectively.

In an operational block 1330, the method 1300 further comprises reducing noise in the transducer output signals in response to the sensor output signals to generate noise-reduced transducer output signals. For example, the assembly 300 can comprise an adaptive filter circuit (e.g., as described herein with respect to FIGS. 4 and 5) which receives the transducer output signals Mic(k) and the sensor output signals Acc(k) and generates the noise-reduced transducer output signals. As shown in FIG. 13, the sensor output signals Acc(k) can be filtered (e.g., multiplied by a filtering function W(k)) and the filtered sensor output signals Fb(k) =Acc(k)*W(k) can be subtracted from the transducer output signals Mic(k) to generate the noise-reduced transducer output signals Cancel(k). In this way, certain embodiments utilizes the filtered sensor output signals Fb(k) to reduce (e.g., remove) the effects of motion (e.g., vibrations; mechanical feedback) and/or noise (e.g., biological noise) from the transducer output signals Mic(k), thereby providing noise-reduced transducer output signals Cancel(k) that are less affected by the non-ambient noise signals.

In an operational block 1340, the method 1300 further comprises updating a vibration response function of the acoustic transducer in response to the noise-reduced transducer output signals and the sensor output signals to generate an updated vibration response function. Updating the vibration response function in certain embodiments comprises generating transducer output signals 322 from the acoustic transducer 320 while vibrations are applied to the implanted assembly 300, generating sensor output signals 332 from the motion sensor 330 while the vibrations are applied to the implanted assembly 300, and in response to the transducer output signals 322 and the sensor output signals 332, calculating the updated vibration response function.

For example, for an acoustic prosthesis 100 comprising a cochlear implant system, the adjustable filter 510 (e.g., adaptive filter circuit) can continuously measure the vibration response function using the transducer output signals 322 and the sensor output signals 332 generated from body noise. For another example, for an acoustic prosthesis 200 comprising a middle ear implant system, the adjustable filter 510 (e.g., adaptive filter circuit) can continuously measure the vibration response function using the transducer output signals 322 and the sensor output signals 332 generated from feedback vibrations generated by the actuator 210.

The updated vibration response function of certain embodiments is proportional to a ratio of the transducer output signals 322 and the sensor output signals 332 (e.g., as described herein with regard to FIG. 8B). For example, as shown in FIG. 13, the filtering function W(k) can be updated in response to Cancel(k) and Acc(k), and this updated filtering function W(k) can then be used to generate the filtered sensor output signals Fb(k) (e.g., using an adjustable filter 510 as shown in FIG. 5). The filtering function W(k) can be updated in response to the sensor output signals Acc(k) and the noise-reduced transducer output signals Cancel(k) using the relation $$W(k) = W(k) + \frac{\mu(k)}{\|Acc(k)\|^2} * \text{Cancel}(k) * conj(Acc(k))$$

where μ(k) is an adaptation speed of the adaptive filter, and conj(Acc(k)) is the complex conjugate of Acc(k).

Besides using the updated filtering function W(k) to generate the noise-reduced transducer output signals Cancel (k), the updated filtering function W(k) can be further processed to be used as the updated vibration response function. In certain embodiments, time-averaging can be applied (e.g., to the transducer output signals, the sensor output signals, or both) prior to calculating the updated vibration response function. For example, as shown in FIG. 13, the updated filtering function W(k) can be expressed on a decibel scale $W_{dB}(k)=20*\log 10(\text{abs}(W(k))$, and low-pass averaged and smoothed, e.g., $W_{dB1}(k)=(1-\propto)*W_{dB1}(k)+\propto*W_{dB}(k)$, where ∝ is a time constant for the low-pass averaging. $W_{dB1}(k)$ can be used as a long smooth averaged version of the updated vibration response function. The low-pass averaging and smoothing in certain embodiments is performed using a time constant ∝ that is indicative of a time scale (e.g., minutes; hours; days) that is longer than the time scale (e.g., seconds) used by the adaptive filter 510 for canceling of body noise and vibration feedback. In certain embodiments, as described more fully herein, the measured vibration response function of the acoustic transducer 320 are time-averaged over a time period (e.g., minutes; hours; days) that is longer than the time scale for variations of the position of the recipient's head.

In an operational block 1350, the method 1300 further comprises accessing a reference vibration response function $VibRef_{dB}(k)$ of the acoustic transducer 320. The reference vibration response function $VibRef_{dB}(k)$ (e.g., also referred to as $VRF_{mic}$ herein) can be previously stored in a storage device 350 of the implanted assembly 300. For example, the reference vibration response function $VibRef_{dB}(k)$ can be generated and stored in accordance with at least one of the example methods 1000, 1100 of FIGS. 9 and 10 (e.g., during a fitting procedure).

In an operational block 1360, the method 1300 further comprises accessing an acoustic sensitivity function $SensRef_{dB}(k)$ of the acoustic transducer 320. The acoustic sensitivity function $SensRef_{dB}(k)$ (e.g., also referred to as $ASF_{mic}$ herein) can be previously stored in the storage device 350 of the implanted assembly 300. For example, the acoustic sensitivity function $SensRef_{dB}(k)$ can be generated and stored in accordance with at least one of the example methods 1000, 1100 of FIGS. 9 and 10 (e.g., during a fitting procedure) under the same environmental conditions (e.g., external atmospheric pressure; thickness of the skin overlaying the implanted assembly 300) as when the reference vibration response function $VibRef_{dB}(k)$ was generated.

In an operational block 1370, the method 1300 further comprises updating the acoustic sensitivity function Sens- $Ref_{dB}(k)$ in response to the updated vibration response function (e.g., $W_{dB1}(k)$) and the reference vibration response function (e.g., $VibRef_{dB}(k)$) to generate an updated acoustic sensitivity function $NewSens_{dB}(k)$. For example, updating the acoustic sensitivity can comprise detecting differences between the vibration response function (e.g., $W_{dB1}(k)$) and the reference vibration response function (e.g., $VibRef_{dB}(k)$) and generating the updated acoustic sensitivity function (e.g., $NewSens_{dB}(k)$) in response to the detected differences. In certain embodiments, the difference between the reference acoustic sensitivity function $SensRef_{dB}(k)$ and the updated acoustic sensitivity function $NewSens_{dB}(k)$ is equal to the detected differences of these vibration response functions (e.g., the same amount of change in the same frequency region), while in certain other embodiments, the difference between the reference acoustic sensitivity function $SensRef_{dB}(k)$ and the updated acoustic sensitivity function $NewSens_{dB}(k)$ is proportional to the detected differences of these vibration response functions (e.g., by a predetermined conversion factor) and/or can be clipped or shaped according to global adjustments or limitation values.

As shown in FIG. 13, the reference vibration response function $VibRef_{dB}(k)$ and the updated vibration response function $W_{dB1}(k)$ can be used to calculate $W_{dB2}(k)$, e.g., using a difference between the two quantities: $W_{dB2}(k)=VibRef_{dB}(k)-W_{dB1}(k)$, which can undergo shape filtering (e.g., $W_{dB3}(k)=W_{dB2}(k)*S_A(k)+S_B(k)$, where $S_A(k)$ and $S_B(k)$ are compensation values for the shape filtering) and limit filtering (e.g., $W_{dB4}(k)=\max(\min(W_{dB3}(k), L_{max}(k), L_{min}(k))$, where $L_{min}(k)$ and $L_{max}(k)$ are limit values for the limit filtering), and the resulting function $W_{dB4}(k)$ can be used to calculate the updated acoustic sensitivity function, e.g., $NewSens_{dB}(k)=SensRef_{dB}(k)+W_{dB4}(k)$.

In certain embodiments, the method 1300 further comprises applying a gain to the noise-reduced transducer output signals (e.g., Cancel(k)) to generate assembly output signals. The gain can be adjusted in response to the updated acoustic sensitivity function (e.g., $NewSens_{dB}(k)$). For example, in response to Cancel(k) and $NewSens_{dB}(k)$, signal processing circuitry of the microphone assembly 300 (e.g., gain circuitry 340 and processor 360) can generate the assembly output signals 342. The gain can provide compensation for changes of the acoustic sensitivity function due to changes of the environmental conditions (e.g., external pressure) experienced by the implantable assembly 300. The gain can include one or more additional offsets to emphasize one or more frequency ranges and can be limited to a predetermined maximum deviation (e.g., ±6 dB).

In certain embodiments, the method 1300 further comprises generating stimulation signals in response to the assembly output signals and providing the stimulation signals to at least a portion of the auditory system of the recipient. For example, a stimulator unit 120 for an acoustic prosthesis 100 comprising a cochlear implant device can receive the assembly output signals 342 from the assembly 300 and can generate and provide stimulation signals to at least a portion of the recipient's cochlea. For another example, an actuator 210 for an acoustic prosthesis 200 comprising a middle ear implant can receive the assembly output signals 342 from the assembly 300 and can generate and provide vibration signals to at least a portion of the recipient's ossicles.

It is to be appreciated that the embodiments disclosed herein are not mutually exclusive and may be combined with one another in various arrangements.

The invention described and claimed herein is not to be limited in scope by the specific example embodiments herein disclosed, since these embodiments are intended as illustrations, and not limitations, of several aspects of the invention. Any equivalent embodiments are intended to be within the scope of this invention. Indeed, various modifications of the invention in form and detail, in addition to those shown and described herein, will become apparent to those skilled in the art from the foregoing description. Such modifications are also intended to fall within the scope of the claims.

The breadth and scope of the invention should not be limited by any of the example embodiments disclosed herein, but should be defined only in accordance with the claims and their equivalents.

Certain Embodiments

Certain embodiments are listed below. The following embodiments are presented for explanatory and illustrative purposes only. It will be appreciated that the foregoing description is not limited to the following embodiments.

Embodiment 1: A method comprising: providing an acoustic prosthesis comprising an assembly implanted within the body of a recipient, the implanted assembly comprising an acoustic transducer and a motion sensor; providing an acoustic sensitivity function of the acoustic transducer to acoustic signals having a first range of frequencies; storing the acoustic sensitivity function in a storage device of the implanted assembly; generating a vibration response function of the acoustic transducer to vibrations having a second range of frequencies; and storing the vibration response function in the storage device of the implanted assembly.

Embodiment 2: The method of Embodiment 1, wherein providing the acoustic sensitivity function of the acoustic transducer comprises: measuring an acoustic response function of the acoustic transducer to acoustic signals having a first range of frequencies; measuring a reference acoustic response function of a reference acoustic transducer to acoustic signals having the first range of frequencies, the reference acoustic transducer positioned externally to the recipient; and in response to the measured acoustic response function and the measured reference acoustic response function, generating an acoustic sensitivity function of the acoustic transducer to acoustic signals having the first range of frequencies.

Embodiment 3: The method of Embodiment 2, wherein measuring the acoustic response function and measuring the reference acoustic response function are performed sequentially.

Embodiment 4: The method of Embodiment 2, wherein measuring the acoustic response function and measuring the reference acoustic response function are performed concurrently.

Embodiment 5: The method of any of Embodiments 2 to 4, wherein the acoustic sensitivity function is generated in response to a ratio of the measured reference acoustic response function and the measured acoustic response function.

Embodiment 6: The method of any of Embodiments 2 to 5, further comprising measuring noise floor levels for the acoustic response function and the reference acoustic response function while the acoustic transducer and the reference acoustic transducer are not exposed to acoustic signals generated externally to the recipient.

Embodiment 7: The method of any of Embodiments 1 to 6, wherein storing the vibration response function comprises storing the vibration response function as a reference vibration response function of the acoustic transducer.

Embodiment 8: The method of any of Embodiments 1 to 7, wherein the acoustic signals having the first range of frequencies comprise white noise.

Embodiment 9: The method of any of Embodiments 1 to 8, further comprising generating the acoustic signals using a speaker positioned externally to the recipient.

Embodiment 10: The method of any of Embodiments 1 to 9, further comprising, in response to the acoustic sensitivity function, calibrating gain circuitry of the implanted assembly, the gain circuitry configured to receive output signals from the acoustic transducer and to apply a gain to the output signals to generate assembly output signals.

Embodiment 11: The method of any of Embodiments 1 to 10, wherein generating the vibration response function comprises: applying vibrations having the second range of frequencies to the implanted assembly; measuring transducer output signals from the acoustic transducer while applying the vibrations; measuring sensor output signals from the motion sensor while applying the vibrations; and in response to the transducer output signals and the sensor output signals, calculating the vibration response function across the second range of frequencies.

Embodiment 12: The method of Embodiment 11, wherein the vibration response function is proportional to a ratio of the transducer output signals and the sensor output signals.

Embodiment 13: The method of any of Embodiments 1 to 12, wherein the acoustic prosthesis comprises a middle ear implant utilizing a totally implantable actuator and the vibrations are generated by the actuator.

Embodiment 14: The method of Embodiment 13, wherein the vibrations include maximum length sequence (MLS) noise.

Embodiment 15: The method of any of Embodiments 1 to 12, wherein the acoustic prosthesis comprises a cochlear implant and the vibrations are generated by the recipient.

Embodiment 16: A method comprising: providing an implanted acoustic prosthesis comprising an assembly implanted within the body of a recipient, the implanted assembly comprising an acoustic transducer and a motion sensor; generating transducer output signals from the acoustic transducer and sensor output signals from the motion sensor; reducing noise in the transducer output signals in response to the sensor output signals to generate noise-reduced transducer output signals; updating a vibration response function of the acoustic transducer in response to the noise-reduced transducer output signals and the sensor output signals to generate an updated vibration response function; accessing a reference vibration response function of the acoustic transducer, the reference vibration response function previously stored in a storage device of the implanted assembly; accessing an acoustic sensitivity function of the acoustic transducer previously stored in the storage device of the implanted assembly; and updating the acoustic sensitivity function in response to the updated vibration response function and the reference vibration response function to generate an updated acoustic sensitivity function.

Embodiment 17: The method of Embodiment 16, further comprising applying a gain to the noise-reduced transducer output signals to generate assembly output signals, the gain adjusted in response to the updated acoustic sensitivity function.

Embodiment 18: The method of Embodiment 17, further comprising generating stimulation signals in response to the assembly output signals and providing the stimulation signals to at least a portion of the auditory system of the recipient.

Embodiment 19: The method of any of Embodiments 16 to 18, wherein reducing noise in the transducer output signals comprises providing the transducer output signals and the sensor output signals to an adaptive filter circuit of the implanted assembly, the adaptive filter circuit generating the noise-reduced transducer output signals.

Embodiment 20: The method of any of Embodiments 16 to 19, wherein updating the vibration response function comprises: generating transducer output signals from the acoustic transducer while vibrations are applied to the implanted assembly; generating sensor output signals from the motion sensor while the vibrations are applied to the implanted assembly; and in response to the transducer output signals and the sensor output signals, calculating the updated vibration response function.

Embodiment 21: The method of Embodiment 20, wherein the updated vibration response function is proportional to a ratio of the transducer output signals and the sensor output signals.

Embodiment 22: The method of Embodiment 20 or Embodiment 21, further comprising applying time-averaging the transducer output signals and the sensor output signals prior to calculating the updated vibration response function.

Embodiment 23: The method of any of Embodiments 20 to 22, wherein updating the acoustic sensitivity comprises detecting differences between the vibration response function and the reference vibration response function, and generating the updated acoustic sensitivity function in response to the detected differences.

Embodiment 24: An apparatus comprising: at least one housing configured to be implanted within a body of a recipient; at least one acoustic transducer positioned on or within the at least one housing, the at least one acoustic transducer configured to respond to sound by generating transducer output signals indicative of the sound; at least one motion sensor positioned on or within the at least one housing, the at least one motion sensor configured to respond to vibrations by generating sensor output signals indicative of the vibrations; gain circuitry configured to receive the transducer output signals from the at least one acoustic transducer and to apply a gain to the transducer output signals; at least one storage device comprising: a reference acoustic sensitivity function of the at least one acoustic transducer; and a reference vibration response function of the at least one acoustic transducer; and at least one processor operatively coupled to the at least one acoustic transducer, the at least one motion sensor, the gain circuitry, and the at least one storage device, the at least one processor configured to adjust the gain circuitry in response to the reference acoustic sensitivity function, the reference vibration response function, the transducer output signals, and the sensor output signals.

Embodiment 25: The apparatus of Embodiment 24, wherein the at least one processor is further configured to: in response to the transducer output signals and the sensor output signals, generate a vibration response function of the at least one acoustic transducer; perform a comparison of the vibration response function to the reference vibration response function; and update the reference acoustic sensitivity function in response to the comparison of the vibration response function and the reference vibration response function.

Embodiment 26: The apparatus of Embodiment 24 or Embodiment 25, wherein the apparatus comprises an implantable assembly of a cochlear implant system.

Embodiment 27: The apparatus of Embodiment 24 or Embodiment 25, wherein the apparatus comprises an implantable assembly of a middle ear implant system.

Embodiment 28: The apparatus of any of Embodiments 24 to 27, wherein the at least one acoustic transducer and the at least one motion sensor are within at least one first housing of the at least one housing, and the at least one processor, the gain circuitry, and the at least one storage device are within a second housing of the at least one housing, the second housing separate from the at least one first housing.

Embodiment 29: The apparatus of any of Embodiments 24 to 27, wherein the at least one housing comprises a single housing containing the at least one acoustic transducer, the at least one motion sensor, the at least one processor, the gain circuitry, and the at least one storage device.

What is claimed is:

1. A method comprising:

providing an acoustic prosthesis comprising an assembly implanted within the body of a recipient, the implanted assembly comprising an acoustic transducer and a motion sensor;

providing an acoustic sensitivity function of the acoustic transducer to acoustic signals having a first range of frequencies;

storing the acoustic sensitivity function in a storage device of the implanted assembly;

generating a vibration response function of the acoustic transducer to vibrations having a second range of frequencies, wherein generating the vibration response function comprises:

applying vibrations having the second range of frequencies to the implanted assembly;

measuring transducer output signals from the acoustic transducer while applying the vibrations;

measuring sensor output signals from the motion sensor while applying the vibrations; and in response to the transducer output signals and the sensor output signals, calculating the vibration response function across the second range of frequencies;

storing the vibration response function in the storage device of the implanted assembly; and detecting changes of the vibration response function due to changes of the externally applied ambient pressure and using the detected changes of the vibration response function to compensate for corresponding changes of the acoustic sensitivity function due to the changes of the externally applied ambient pressure.

2. The method of claim 1, wherein providing the acoustic sensitivity function of the acoustic transducer comprises:

using a computer system, emitting the acoustic signals having the first range of frequencies and measuring an acoustic response function of the acoustic transducer to the acoustic signals;

measuring a reference acoustic response function of a reference acoustic transducer to the acoustic signals, the reference acoustic transducer positioned externally to the recipient; and in response to the measured acoustic response function and the measured reference acoustic response function, generating the acoustic sensitivity function of the acoustic transducer to the acoustic signals.

3. The method of claim 2, wherein measuring the acoustic response function and measuring the reference acoustic response function are performed sequentially.

4. The method of claim 2, wherein measuring the acoustic response function and measuring the reference acoustic response function are performed concurrently.

5. The method of claim 2, wherein the acoustic sensitivity function is generated in response to a ratio of the measured reference acoustic response function and the measured acoustic response function.

6. The method of claim 2, further comprising measuring noise floor levels for the acoustic response function and the reference acoustic response function while the acoustic transducer and the reference acoustic transducer are not exposed to acoustic signals generated externally to the recipient.

7. The method of claim 1, wherein storing the vibration response function comprises storing the vibration response function as a reference vibration response function of the acoustic transducer.

8. The method of claim 1, wherein the acoustic signals having the first range of frequencies comprise white noise.

9. The method of claim 1, further comprising generating the acoustic signals using a speaker positioned externally to the recipient.

10. The method of claim 1, further comprising, in response to the acoustic sensitivity function, calibrating gain circuitry of the implanted assembly, the gain circuitry configured to receive output signals from the acoustic transducer and to apply a gain to the output signals to generate assembly output signals.

11. The method of claim 1, wherein the vibration response function is proportional to a ratio of the transducer output signals and the sensor output signals.

12. The method of claim 1, wherein the acoustic prosthesis comprises a middle ear implant utilizing a totally implantable actuator and the vibrations are generated by the actuator.

13. The method of claim 12, wherein the vibrations include maximum length sequence (MLS) noise.

14. The method of claim 1, wherein the acoustic prosthesis comprises a cochlear implant and the vibrations are generated by the recipient.

15. A method comprising:

providing an implanted acoustic prosthesis comprising an assembly implanted within the body of a recipient, the implanted assembly comprising an acoustic transducer and a motion sensor;

generating transducer output signals from the acoustic transducer and sensor output signals from the motion sensor;

reducing noise in the transducer output signals in response to the sensor output signals to generate noise-reduced transducer output signals;

updating a vibration response function of the acoustic transducer in response to the noise-reduced transducer output signals and the sensor output signals to generate an updated vibration response function;

accessing a reference vibration response function of the acoustic transducer, the reference vibration response function previously stored in a storage device of the implanted assembly;

accessing an acoustic sensitivity function of the acoustic transducer previously stored in the storage device of the implanted assembly; and updating the acoustic sensitivity function in response to the updated vibration response function and the reference vibration response function to generate an updated acoustic sensitivity function.

16. The method of claim 15, further comprising applying a gain to the noise-reduced transducer output signals to generate assembly output signals, the gain adjusted in response to the updated acoustic sensitivity function.

17. The method of claim 16, further comprising generating stimulation signals in response to the assembly output signals and providing the stimulation signals to at least a portion of the auditory system of the recipient.

18. The method of claim 15, wherein reducing noise in the transducer output signals comprises providing the transducer output signals and the sensor output signals to an adaptive filter circuit of the implanted assembly, the adaptive filter circuit generating the noise-reduced transducer output signals.

19. The method of claim 15, wherein updating the vibration response function comprises:

generating transducer output signals from the acoustic transducer while vibrations are applied to the implanted assembly;

generating sensor output signals from the motion sensor while the vibrations are applied to the implanted assembly; and in response to the transducer output signals and the sensor output signals, calculating the updated vibration response function.

20. The method of claim 19, wherein the updated vibration response function is proportional to a ratio of the transducer output signals and the sensor output signals.

21. The method of claim 19, further comprising applying time-averaging the transducer output signals and the sensor output signals prior to calculating the updated vibration response function.

22. The method of claim 19, wherein updating the acoustic sensitivity comprises detecting differences between the vibration response function and the reference vibration response function, and generating the updated acoustic sensitivity function in response to the detected differences.

23. An apparatus comprising:

at least one housing configured to be implanted within a body of a recipient;

at least one acoustic transducer positioned on or within the at least one housing, the at least one acoustic transducer configured to respond to sound by generating transducer output signals indicative of the sound;

at least one motion sensor positioned on or within the at least one housing, the at least one motion sensor configured to respond to vibrations by generating sensor output signals indicative of the vibrations;

gain circuitry configured to receive the transducer output signals from the at least one acoustic transducer and to apply a gain to the transducer output signals;

at least one storage device comprising:

a reference acoustic sensitivity function of the at least one acoustic transducer; and a reference vibration response function of the at least one acoustic transducer; and at least one processor operatively coupled to the at least one acoustic transducer, the at least one motion sensor, the gain circuitry, and the at least one storage device, the at least one processor configured to:

adjust the gain circuitry in response to the reference acoustic sensitivity function, the reference vibration response function, the transducer output signals, and the sensor output signals;

in response to the transducer output signals and the sensor output signals, generate a vibration response function of the at least one acoustic transducer;

perform a comparison of the vibration response function to the reference vibration response function; and update the reference acoustic sensitivity function in response to the comparison of the vibration response function and the reference vibration response function.

24. The apparatus of claim 23, wherein the apparatus comprises an implantable assembly of a cochlear implant system.

25. The apparatus of claim 23, wherein the apparatus comprises an implantable assembly of a middle ear implant system.

26. The apparatus of claim 23, wherein the at least one acoustic transducer and the at least one motion sensor are within at least one first housing of the at least one housing, and the at least one processor, the gain circuitry, and the at least one storage device are within a second housing of the at least one housing, the second housing separate from the at least one first housing.

27. The apparatus of claim 23, wherein the at least one housing comprises a single housing containing the at least one acoustic transducer, the at least one motion sensor, the at least one processor, the gain circuitry, and the at least one storage device.

* * * * *